US006565194B2

(12) United States Patent
Ogawa et al.

(10) Patent No.: US 6,565,194 B2
(45) Date of Patent: May 20, 2003

(54) IMAGE FORMING METHOD AND IMAGE FORMING APPARATUS

(75) Inventors: Katsutoshi Ogawa, Osaka (JP); Hiroshi Saegusa, Tochigi (JP); Yoshitaka Kitaoka, Osaka (JP); Taichi Itoh, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/181,326

(22) PCT Filed: Apr. 25, 2001

(86) PCT No.: PCT/JP01/03591

§ 371 (c)(1),
(2), (4) Date: Jul. 16, 2002

(87) PCT Pub. No.: WO01/81092

PCT Pub. Date: Nov. 1, 2001

(65) Prior Publication Data

US 2003/0001925 A1 Jan. 2, 2003

(30) Foreign Application Priority Data

Apr. 25, 2000 (JP) ..... 2000-123752

(51) Int. Cl.[7] ..... B41J 2/06

(52) U.S. Cl. ..... 347/55

(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 3,689,935 A 9/1972 Pressman et al.

FOREIGN PATENT DOCUMENTS

| | | |
|---|---|---|
| JP | 44-26333 | 11/1969 |
| JP | 60-20747 | 5/1985 |
| JP | 8-258317 | 10/1996 |
| JP | 9-500842 | 1/1997 |
| WO | 95-24675 | 9/1995 |

OTHER PUBLICATIONS

International Search Report—PCT/JP01/03591, ISA/JP. Jul. 25, 2001.

*Primary Examiner*—Raquel Yvette Gordon
(74) *Attorney, Agent, or Firm*—Harness, Dickey & Pierce, PLC

(57) ABSTRACT

To keep a toner (1) deposited on a transportation belt (21) from contact with a printhead (4) and prevent the clogging of toner passage holes (6) of the printhead (4), the toner (1) on a toner holding member (2) is ejected toward the transportation belt (21) through the toner passage holes (6) after the movement of the transportation belt (21) is initiated such that the cleaning of the toner passage holes (6) is initiated.

20 Claims, 14 Drawing Sheets

Control Voltage

Deflection Voltage L

Deflection Voltage R

Image Voltage

Reference Voltage

Control Voltage

IMAGE FORMING METHOD AND IMAGE FORMING APPARATUS

TECHNICAL FIELD

The present invention relates to an image forming method and an image forming apparatus each for use in a copier, a facsimile, a printer, or the like. In particular, it relates to image formation performed by controlling a developer jumping from a developer holding member to a rear electrode by means of a printhead controlled by an image signal and causing the developer to adhere to an image receiving member positioned between the printhead and the rear electrode.

BACKGROUND ART

With recent improvements in the performance of personal computers and recent advances in networking technology, there have been growing demands for printers with high processing abilities which can handle not only voluminous documents but also color documents. However, an image forming apparatus capable of outputting monochrome and color documents of sufficiently high quality and having a high processing speed is still under development, the advent of which has been expected.

As one of technologies which implement such a high-performance image forming apparatus, there has conventionally been known an image forming technology which causes a toner to jump onto a recording sheet or image-forming means such as an intermediate image holding belt under the effect of an electric field.

As examples of an image forming apparatus of this type, there have been known image forming apparatus disclosed in Japanese Examined Patent Publication No. SHO 44-26333, U.S. Pat. No. 3,689,935 (Japanese Examined Patent Publication No. SHO 60-20747), Japanese Domestic-Phase PCT Patent Application No. HEI 9-500842, and the like.

Referring to FIG. 12, a description will be given to an image forming apparatus proposed in the specification and drawings of Japanese Patent Application No. HEI 10-100780 as an example of a similar image forming apparatus. In FIG. 12, 31 denotes a grounded toner holding member for holding and transporting a charged toner, 32 denotes a regulating blade for controlling the toner in one to three layers on the toner holding member 31, 33 denotes a supply roller for charging and supplying the toner to the toner holding member 31, and 34 denotes a printhead formed with a toner passage hole 35. A control electrode 36 is formed around the toner passage hole 36. A voltage corresponding to an image signal is applied from a control power supply 37, such as a driving IC, to the control electrode 36. 38 denotes a rear electrode, 39 denotes a power supply for the rear electrode 38, and 40 denotes receiving means such as a recording sheet transported on the rear electrode 38.

In the arrangement, the supply roller 33 and the toner holding member 31 are operated such that a uniform toner layer is formed on the toner holding member 31 by means of the regulating blade 32 and transported. Under these conditions, a voltage is applied to the rear electrode 38 and a voltage corresponding to the image signal is applied from the control power supply 37 to the control electrode 36 in synchronization with the movement of the image receiving means 40 while it is moved. Consequently, the toner on the toner holding member 31 passes through the toner passage hole 35 in response to the image signal to jump onto the image receiving means 40 and form a required image thereon.

To form a fine image at, e.g., 600 dpi (a density of 600 dots per inch) on the entire surface of the image receiving means 40, a plurality of toner passage holes 35 should be formed in the printhead 34. Even if the toner passage holes 35 are arranged in a row, a fine image as mentioned above cannot be formed so that the toner passage holes 35 and the control electrodes 36 are arranged in a plurality of rows (e.g., eight rows in an example shown in the drawing), as shown in FIG. 13. The toner passage holes 35 and the control electrodes 36 have, e.g., circular configurations. Connecting electrodes electrically connecting to each of the control electrodes 36 are provided on both sides of the toner holding member 31 to extend along the moving direction thereof for the prevention of mutual interference therebetween. Each of the connecting electrodes is connected to the lead of the control power supply 37 for outputting a control voltage, such as a driving IC.

Although the image receiving means 40 is composed of a recording sheet or the like such that an image is formed directly thereon in the exemplary structure shown in FIG. 12, the recording sheet or the like is disadvantageous in that the thickness thereof easily varies, the properties thereof easily change due to humidity, and it is prone to deformation during movement. In the case of color printing, it is difficult to synchronize the timings for image formations in different colors due to inconsistent transportation of the recording sheet so that image quality is likely to be lowered.

To prevent this, there are cases where an intermediate image holding belt is used preferably as the image receiving means 40 so that images formed on the image holding belt are transferred simultaneously onto a recording sheet or the like, as shown in the specification and drawings of, e.g., Japanese Patent Application No. HEI 10-100780.

Referring to FIG. 14, a description will be given to a structure using the image holding belt. In FIG. 14, 43 denotes an endless image holding belt as the image receiving means 40 which is composed of a resin film having conductive fillers dispersed therein and a resistivity of $10^{10}$ Ωcm. The image holding belt 43 is wound around a pair of rollers 44*a* and 44*b*. 45 denotes a pickup roller for feeding out recording sheets 46 on a one-by-one basis from a sheet feed tray 50. 47 denotes a timing roller for providing synchronism between the fed recording sheet 46 and the position of an image. 48 denotes a transfer roller for transferring a toner image formed on the image holding belt 43 onto the recording sheet 46. The transfer roller 48 is pressed toward the roller 44*a* with the image holding belt 43 interposed therebetween, while a transfer voltage is applied thereto. 49 denotes a fixing unit for fixing the toner image to the recording sheet 46 by heating and pressing the recording sheet 46 having the toner image transferred thereon.

However, the foregoing image forming apparatus has the problem of so-called clogging. As the apparatus is used for a longer period, toner particles gradually clog the toner passage holes (printhead openings) and hamper precise recording. As a method for preventing clogging, there has been known one which cleans the openings of the printhead by ejecting the toner from the toner holding member (toner supplying member) through the printhead openings.

Specifically, there have been proposed a method of applying an ultrasonic wave to the printhead, a method of applying a voltage to an electrode provided on the printhead, a method of forcibly pressing the toner supplying member onto the printhead, and the like.

However, if the toner ejected for cleaning in accordance with the foregoing conventional methods is large in amount, the toner deposited on the rear electrode reaches the printhead to enter the printhead openings. If the toner is further ejected under this condition, the deposited toner presses the toner in the printhead openings so that the toner solidifies in the printhead openings. This leads to the problem that clogging is caused by the toner ejected for cleaning.

Clogging resulting from the deposition of the ejected toner presents a serious problem not only in the cleaning step but also on other occasions. For example, clogging as described above occurs when a driving system for the rear electrode is out of order or when a driving roller for the intermediate transfer belt skids and the intermediate transfer belt rotates free.

If the toner is ejected in the clogging state, the toner solidifies in the openings, which resultingly damages the printhead.

There is still another problem that, if the toner is deposited on the opposing member during ejection, so-called in-apparatus contamination is likely to occur. On collision with the toner on the opposing member, the ejected toner is scattered to a periphery to contaminate the inside of the apparatus, thereby causing the in-apparatus contamination.

If a large mount of toner is deposited on the opposing member, the toner adheres to the printhead due to electrostatic repulsion between toner particles. As a result, an electric field is distorted by the charge of the toner adhered to the head so that the direction of the jumping toner is distorted.

The present invention has been achieved in view of the foregoing and it is therefore a primary object of the present invention to keep the developer deposited on the opposing member from contact with the printhead and prevent the clogging of the printhead openings.

DISCLOSURE OF THE INVENTION

To attain the object, the present invention provides a method for forming an image, the method comprising: an opposing member moving step of moving an opposing member disposed in opposing relation to a developer supplying member for supplying a developer with a printhead interposed therebetween; and an ejecting step of ejecting the developer from the developer supplying member toward the opposing member through openings of the printhead, the ejecting step being initiated after the opposing member moving step is initiated.

By allowing the opposing member to move, the arrangement prevents the developer from being deposited at a localized point on the opposing member, thereby keeping the developer on the opposing member from contact with the printhead and preventing the clogging of the openings. In addition, the probability of collision between developers on the opposing member is also reduced so that in-apparatus contamination due to the jumping of a toner is prevented.

The method can further comprise: a detecting step of detecting a moving state of the opposing member, wherein the initiation of the ejecting step is controlled based on a result of the detection obtained in the detecting step.

The method comprises: an opposing member moving step of moving an opposing member disposed in opposing relation to a developer supplying member for supplying a developer with a printhead interposed therebetween; and a cleaning step of ejecting the developer from the developer supplying member toward the opposing member through openings of the printhead and thereby cleaning the openings of the printhead, the cleaning step being initiated after the opposing member moving step is initiated.

By allowing the opposing member to move, the arrangement prevents the developer ejected during the cleaning of the openings from being deposited at a localized point on the opposing member, thereby keeping the developer on the opposing member from contact with the printhead and preventing the clogging of the openings. The foregoing effect is particularly significant in the cleaning step in which the developer is ejected in large amount per unit time.

A moving speed of the opposing member is adjusted to be higher in the cleaning step for the printhead than in an image forming step of forming a toner image.

The arrangement reduces the amount of deposited toner per unit area on the opposing member in the cleaning step for the printhead. As a result, the printhead can be cleaned by ejecting the toner in large amount.

In the image forming method, a plurality of printheads are arranged in a direction of movement of the opposing member and, of impact positions of developers ejected through each of the openings of the printheads and impacted on the opposing member in the cleaning step, at least one may be different from the others.

In the arrangement, the impact positions of the developers from the plurality of printheads are dispersed. This keeps the toners from contact with the printheads and prevents clogging due to local increases in the amounts of deposited toners.

The plurality of printheads correspond to the developers in a plurality of colors and, of the impact positions of the developers impacted on the opposing member in the cleaning step, the one in the palest color may be positioned closer to an image formation region on the opposing member than the impact positions of the developers in the other colors.

If the developers are ejected in accordance with, e.g., an ultrasonic method or a printhead contact method, the developers impacted on the opposing member are scattered to the peripheries of the impact positions. If the scattered developers enter the image formation region on the opposing member on which a recording member is disposed, the upper and lower end portions of the recording member is contaminated by the scattered developers. If the palest one of the developers in the plurality of colors, such as yellow, is deposited at the position closest to the image formation region, however, contamination becomes inconspicuous even if the developers enter the image formation region.

The impact position of the developer in the palest color can be positioned closer to a tip of the image formation region in a direction in which the opposing member is moved than the impact positions of the developers in the other colors.

In the arrangement, part of the scattered developers float in the space between the printheads and the opposing member to be impacted again on the opposing member so that the tip of the image formation region in the direction of movement is most likely to suffer contamination. By causing the palest one, such as yellow, of the developers to be impacted on the tip portion of the image formation region in the direction of movement, contamination on the tip portion of the image formation region in the direction of movement becomes inconspicuous.

An intensity of an electric field between the printhead and the opposing member can be adjusted to be lower in the cleaning step than in an image forming step of forming an image by ejecting the developer onto the opposing member.

Even if an electrostatic field formed between the printheads and the opposing member divides the developers into those of a positive polarity and those of a negative polarity, the arrangement prevents the developers of one of the positive and negative polarities from adhering to the surfaces of the printheads and allows the developers of each of the positive and negative polarities to reach the opposing member by using the electric field formed between the printhead and the opposing member. Accordingly, the efficiency with which the developers are reclaimed can be increased irrespective of the polarities of the developers.

The method can further comprise: a developer supplying step of supplying the developer from the developer supplying member to a vicinity of each of the openings of the printhead, wherein the cleaning step is initiated prior to the developer supplying step.

The arrangement prevents the ejection of the developer in large amount resulting from the cleaning step performed with a continuous supply of the developer and reduces the amount of the ejected developer by halting the supply of the developer in the cleaning step.

The method may further comprise: an electric field forming step of forming a specified electric field between a group of electrodes around the openings of the printhead and the developer supplying member, wherein the electric field forming step is initiated before the cleaning step is initiated.

By forming the electric field for suppressing the supply of the developer from the developer supplying member, the arrangement reduces the amount of the ejected developer.

The present invention also provides an apparatus for forming an image, the apparatus comprising: a developer supplying member for supplying a developer; an opposing member disposed in opposing relation to the developer supplying member; and a printhead disposed between the developer supplying member and the opposing member and having openings for allowing the developer on the developer supplying member to pass therethrough toward the opposing member based on an image signal from the outside, the opposing member initiates movement before the developer on the developer supplying member is ejected through the openings of the printhead.

By allowing the opposing member to move, the arrangement prevents the developer from being deposited at a localized point on the opposing member, thereby keeping the developer on the opposing member from contact with the printhead and preventing the clogging of the openings.

The apparatus may further comprise: detecting means for detecting the movement of the opposing member; and ejection initiation control means for controlling initiation of the ejection of the developer from the developer supplying means if the movement of the opposing member is detected by the detecting means.

There is also provided an apparatus for forming an image, the apparatus comprising: a developer supplying member for supplying a developer; an opposing member disposed in opposing relation to the developer supplying member; and a printhead disposed between the developer supplying member and the opposing member and having openings for allowing a developer on the developer supplying member to pass therethrough toward the opposing member based on an image signal from the outside, the developer on the developer supplying member being ejected through the openings of the printhead to clean the openings after the opposing member initiates movement.

By allowing the opposing member to move, the arrangement prevents the developer ejected during the cleaning of the openings from being deposited at a localized point on the opposing member, thereby keeping the developer on the opposing member from contact with the printhead and preventing the clogging of the openings. The foregoing effect is particularly significant in the cleaning state in which the developer is ejected in large amount per unit time.

A moving speed of the opposing member can be adjusted to be higher when the openings are cleaned by ejecting the developer on the developer supplying means through the openings of the printhead than when a toner image is formed.

The arrangement reduces the amount of deposited toner per unit area on the opposing member during the cleaning of the printhead. As a result, the printhead can be cleaned by ejecting the toner in large amount.

In the image forming apparatus, a plurality of printheads are arranged in a direction of movement of the opposing member and, of impact positions of developers ejected through each of the openings of the printheads and impacted on the opposing member during a cleaning period for each of the printheads, at least one may be different from the others.

In the arrangement, the impact positions of the developers from the plurality of printheads are dispersed. This keeps the toners from contact with the printheads and prevents clogging due to local increases in the amounts of deposited toners.

The plurality of printheads correspond to the developers in a plurality of colors and, of the impact positions of the developers impacted on the opposing member during the cleaning period for each of the printheads, the one of the palest color can be positioned closer to an image formation region on the opposing member than the impact positions of the developers in the other colors.

If the developers are ejected in accordance with, e.g., an ultrasonic method or a printhead contact method, the developers impacted on the opposing member are scattered to the peripheries of the impact positions. If the scattered developers enter the image formation region on the opposing member on which a recording member is disposed, the upper and lower end portions of the recording member is contaminated by the scattered developers. By depositing the palest one of the developers in the plurality of colors, such as yellow, at the position closest to the image formation region, as described above, the present invention can render contamination inconspicuous even if the developers enter the image formation region.

In the image forming apparatus, the impact position of the developer in the palest color may be positioned closer to a tip of the image formation region on the opposing member in the direction of movement of the opposing member than the impact positions of the developers in the other colors.

In the arrangement, part of the scattered developers float in the space between the printheads and the opposing member to be impacted again on the opposing member so that the tip of the image formation region in the direction of movement of the opposing member is most likely to suffer contamination. By causing the palest one of the developers, such as yellow, to be impacted on the tip portion of the image formation region, contamination on the tip portion of the image formation region becomes inconspicuous.

In the image forming apparatus, an intensity of an electric field between the printhead and the opposing member can be adjusted to be lower during the cleaning period than during image formation during which an image is formed by ejecting the developer onto the opposing member.

Even if an electrostatic field formed between the printheads and the opposing member divides the developers into those of a positive polarity and those of a negative polarity, the arrangement prevents the developers of one of the positive and negative polarities from adhering to the surfaces of the printheads and allows the developers of each of the positive and negative polarities to reach the opposing member by using the electric field formed between the printhead and the opposing member. Accordingly, the efficiency with which the developers are reclaimed can be increased irrespective of the polarities of the developers.

The cleaning of the openings of the printhead is initiated before the developer is supplied from the developer supplying member to a vicinity of each of the openings of the printhead.

The arrangement prevents the ejection of the developer in large amount resulting from the cleaning step performed with a continuous supply of the developer and reduces the amount of the ejected developer by halting the supply of the developer in the cleaning step.

A group of electrodes are provided around the openings of the printhead and a specified electric field is formed between the group of electrodes and the developer supplying member.

By forming the electric field for suppressing the supply of the developer from the developer supplying member, the arrangement reduces the amount of the ejected developer.

The developer that can be used in the present invention is not limited to a dry toner. Other developers including a liquid ink having a pigment or dye dispersed in a fluid dispersion and a wet toner having toner particles dispersed in a fluid dispersion may also be used.

If the liquid ink is used, the developer ejected toward the opposing member such as an intermediate transfer belt or a rear electrode is not deposited as a toner so that the clogging of the openings by the developer deposited on the opposing member does not occur. However, if the liquid ink is impacted in large amount on the same impact position, the opposing member swells or the mechanical strength thereof is reduced significantly due to the penetration of the liquid ink into the opposing member. This causes the problems of a shorter lifetime of the opposing member, degraded registration of a color image due to a change in the size of the opposing member, and a damaged peripheral member such as a damaged printhead due to the deformation of the opposing member. However, the present invention can reduce the foregoing problems since the impact positions of the liquid ink are dispersed. If the liquid ink is impacted on a hard opposing member, the phenomenon of the ink scattered to the periphery of the opposing member may also occur, similarly to the dry toner. Hence, the present invention is effective in either case in solving the problems caused by the phenomenon.

If the wet toner is used, the fluid dispersion reaches the opposing member together with the toner particles. This causes two problems, of which one is associated with the deposition of the toner on the opposing member also observed when the dry toner is used and the other is associated with the penetration of the fluid dispersion into the opposing member also observed when the liquid ink is used. By practicing the present invention, therefore, these problems can be solved.

BEST MODES FOR CARRYING OUT THE INVENTION

Figure 1:
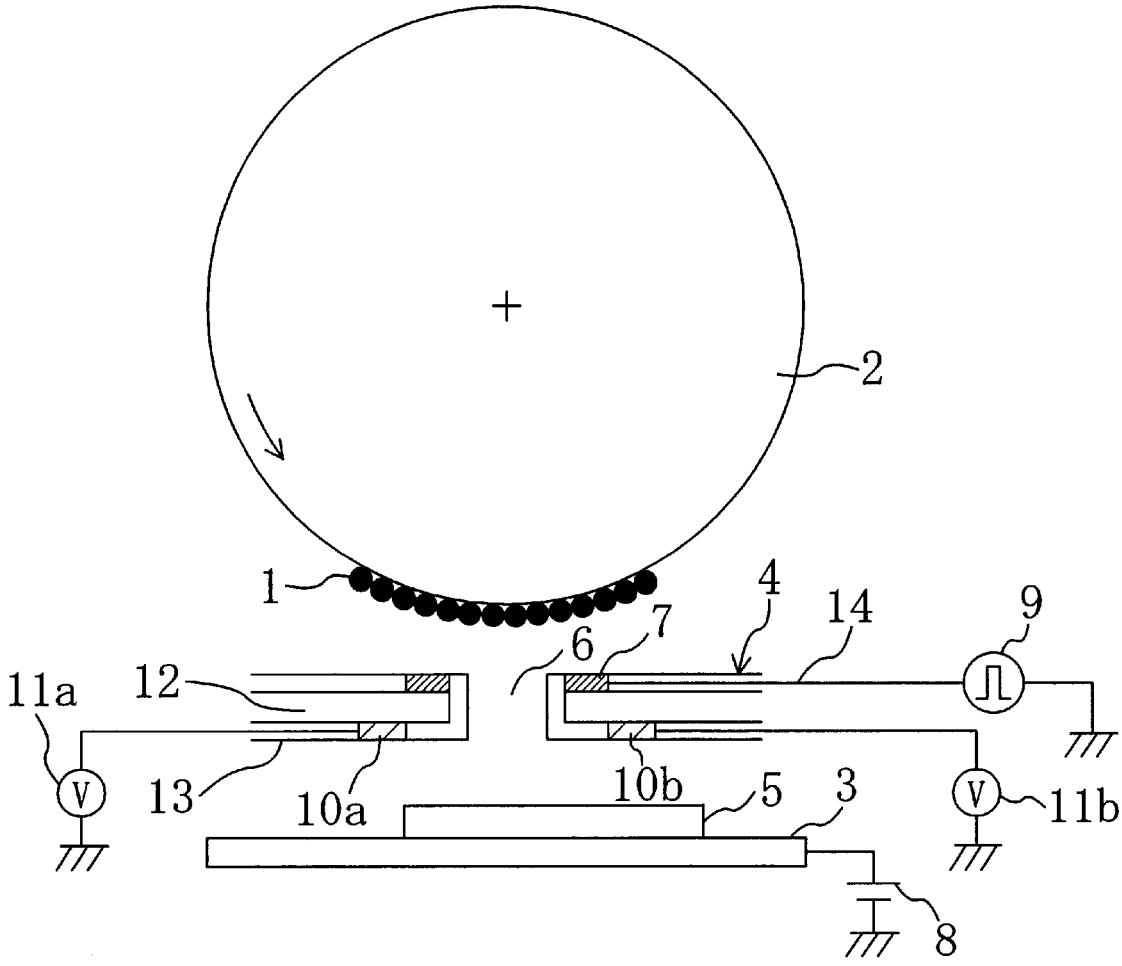
FIG. 1 is a structural view showing a principal portion of an image forming apparatus according to EMBODIMENT 1 of the present invention.

Referring now to the drawings, the best modes for carrying out the present invention will be described as individual embodiments.

Embodiment 1

FIG. 1 is a cross-sectional view schematically showing a structure of an image forming apparatus according to EMBODIMENT 1 of the present invention. In FIG. 1, 1 denotes a toner and 2 denotes a toner holding member for holding and transporting the toner 1. The toner holding member 2 is composed of a cylindrical body made of aluminum and having an outer diameter of 20 mm and a thickness of 1 mm. The toner holding member 2 has a grounded configuration. The toner holding member 2 may also be made of materials other than aluminum including a metal such as iron, an alloy, or a member composed of a rubber material such as a silicon rubber or an urethane rubber wound around a core shaft. Besides a roller-shaped configuration, a belt-like or drum-like configuration may also be used. Instead of grounding the toner holding member 2, a dc voltage or an ac voltage may also be applied. In the case of applying an ac voltage, a dc voltage may be superimposed thereon.

The toner 1 is formed in a layer on the toner holding member 2 by means of a regulating blade (not shown). The regulating blade is formed of an elastic member made of urethane, silicon, or the like and has a hardness of 40 to 80 degree (JIS K6301 A Scale)

The length of the free end of the regulating blade (the length of the portion of the regulating blade extending off a mounting member) for regulating the toner layer on the toner holding member 2 is 5 to 15 nm. A proper linear pressure exerted by the regulating blade on the toner holding member 2 is 5 to 40 g/cm. Under the pressure exerted by the regulating blade, a toner is formed into one to three layers on the toner holding member 2. The regulating blade is used in an electrically floating or grounded state or with the a dc or ac voltage applied thereto. In the present embodiment, the regulating blade is used in the floating state. The toner 1 is sandwiched between the toner holding member 2 and the regulating blade and slightly stirred to receive charge from the toner holding member 2.

The toner 1 is supplied by a supply roller (not shown) to a surface of the toner holding member 2. The supply roller is composed of an expandable synthetic rubber such as urethane formed to a thickness of about 2 to 6 mm on a shaft (with a diameter of 8 mm in the present embodiment) made of metal such as iron. The hardness of a surface of the supply roller is 30 degrees (measured by a method according to JIS K6301 A Scale). The amount of interlocking between the supply roller and the toner holding member 2 is preferably in the range of 0.1 to 2 mm. The supply roller is used in a grounded state or with a dc or ac voltage applied thereto. The supply roller controls the amount of toner supplied to the toner holding member 2 and also aids the charging of the toner 1. The polarity of the charged toner may be either positive or negative. In the present embodiment, the negatively charged toner is used. Preferably, the type and amount of a charge control agent added to the toner are adjusted such that an amount of toner charge q/m is −5 to −30 $\mu$C/g. If the absolute value of the amount of toner charge is smaller than the foregoing range, the toner of the opposite polarity increases so that the toner adheres to the periphery of the toner passage hole 6. This causes the clogging of the toner passage hole 6 or distorts a deflection electric field, thereby preventing the toner from being deflected in a normal direction. If the absolute value of the amount of toner charge is larger than the foregoing range, an image force is enhanced between the toner particles and the toner holding member and the toner particles cannot be desorbed from the toner holding member.

3 denotes a rear electrode. Although the present embodiment has composed of the rear electrode 3 of a metal plate, a resin film having conductive fillers dispersed therein may also be used. In this case, the resistance of the film is preferably on the order of $10^2$ to $10^{12}$ Ωcm. A toner image may also be formed and recorded by causing the toner 1 to adhere directly onto the rear electrode 3 or by placing the image receiving member 5 on the rear electrode 3 and causing the toner to adhere onto the image receiving member 5. It is also possible to process the rear electrode 3 into an endless film configuration, recording the toner directly onto the film, and then transferring the toner image onto the image receiving member 5. The distance between the rear electrode 3 and a printhead 4, which will be described later, is preferably in the range of 50 to 1000 $\mu$m.

8 denotes a voltage source for rear electrode which supplies a constant voltage to the rear electrode 3. The voltage applied to the rear electrode 3 is preferably +500 V to +2000 V and more preferably +800 V to +1500 V. If the voltage applied to the rear electrode 3 is higher than the foregoing range, an electrical short circuit may occur between the printhead 4 and the rear electrode 3 to cause a discharge breakdown therebetween. If the applied voltage is lower than the foregoing range, on the other hand, a force electrostatically attracting the toner 1 toward the rear electrode 3 is reduced and the toner sufficient to print dots at a high density cannot be attracted toward the image receiving member 5.

4 denotes a printhead and 12 denotes an insulating base material composing the printhead 4. The insulating base material 12 has a thickness ranging properly from 10 to 100 $\mu$m and is preferably composed of a material such as polyimide or polyethylene terephthalate. 13 denotes an insulating protective layer covering the surfaces of a control electrode 7 and deflection electrodes 10*a* and 10*b*, which will be described later. The insulating protective layer 13 has a thickness ranging properly from 5 to 30 $\mu$m. It will be appreciated that the material and thickness of each of the insulating base material 12 and the insulating protective layer 13, the number of constituent layers thereof, and the like are not limited thereto. The insulating base material 12 and the insulating protective layer 13 may be designed arbitrarily provided that it has a structure according to the embodiments of the present invention that will be described later.

6 denotes a toner passage hole extending through the printhead 4. The formation of the toner passage hole 6 in the printhead 4 is performed preferably by a punching process using an exciter laser, a YAG laser, a $CO_2$ laser, or the like, followed by en etching process for forming electrodes. The toner passage hole 6 includes a plurality of toner passage holes 6 arranged lengthwise of the printhead 4 to form a row of toner passage holes. The printhead 4 described in the present embodiment has two rows of toner passage holes.

7 denotes a control electrode formed on the surface portion of the base material 12 closer to the toner holding member 2 to surround the periphery of the toner passage hole 6. 10*a* and 10*b* denote deflection electrodes provided on the surface portions of the base material 12 closer to the rear electrode 3 to surround the toner passage hole 6. Each of the control electrode 7 and the deflection electrodes 10*a* and 10*b* is composed of a copper or aluminum foil having a thickness on the order of 2 to 30 $\mu$m. The configuration of the toner passage hole 6 will be described later.

9 denotes a voltage source for control electrode which is connected to the control electrode 7 to supply a voltage pulse to the control electrode 7 in response to an image signal supplied from the outside. The voltage source 9 for control electrode is composed of a voltage generator (not shown) for generating a voltage and switching elements (not shown) for switching the voltage. Each of the switching elements has about 32, 64, or 128 channels and controls the voltage supplied to the control electrode 7. For example, if recording is performed at a recording density (300 dpi) of 300 dots per inch and if switching elements each having 64 channels are used, five switching elements each having 64 channels are required to control 300 openings. 11*a* and 11*b* are voltage sources for deflection electrodes which are connected to the deflection electrodes 10*a* and 10*b*, respectively. The voltage sources 11*a* and 11*b* for deflection electrodes supply voltages to the deflection electrodes 10*a* and 10*b* in synchronization with a voltage pulse supplied from the voltage source 9 for control electrode.

Figure 2A:
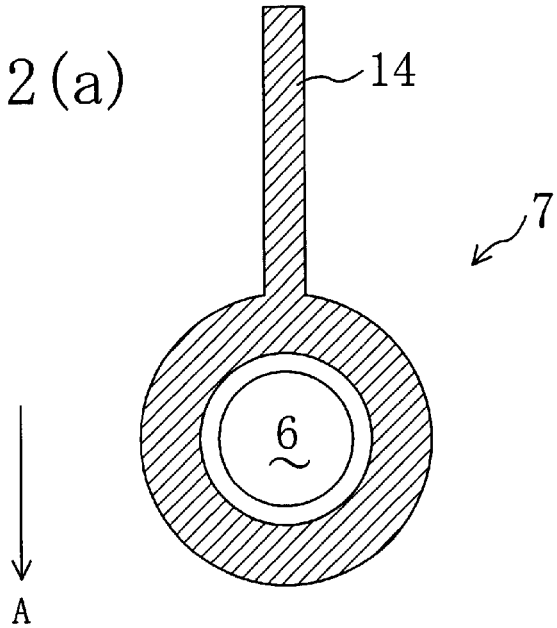
FIG. 2 are enlarged plan views each showing a principal portion of a printhead according to EMBODIMENT 1 of the present invention.
Figure 2B:
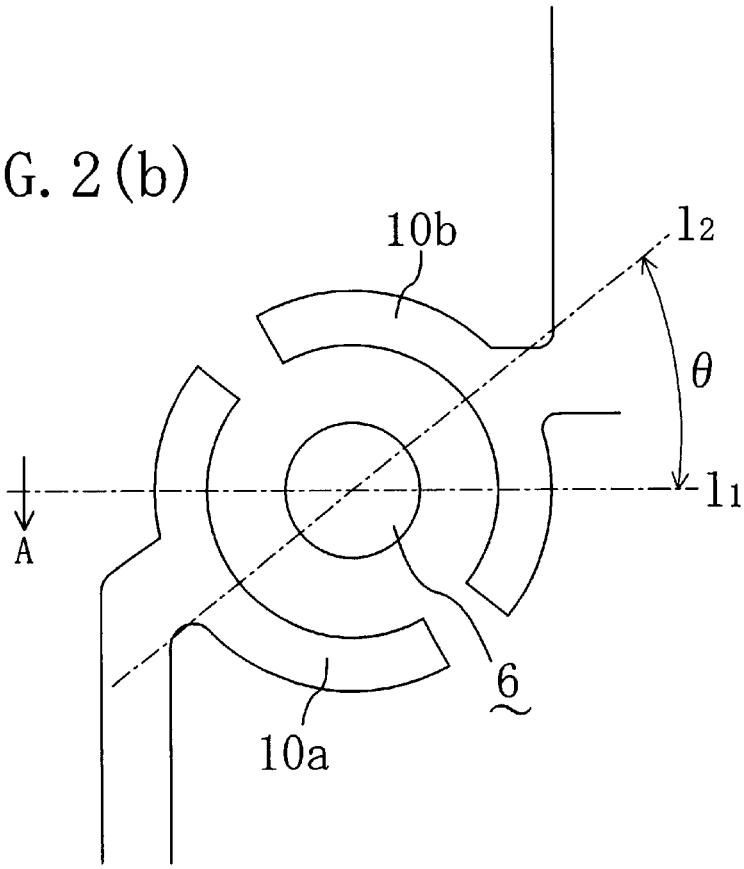
Figure 3A:
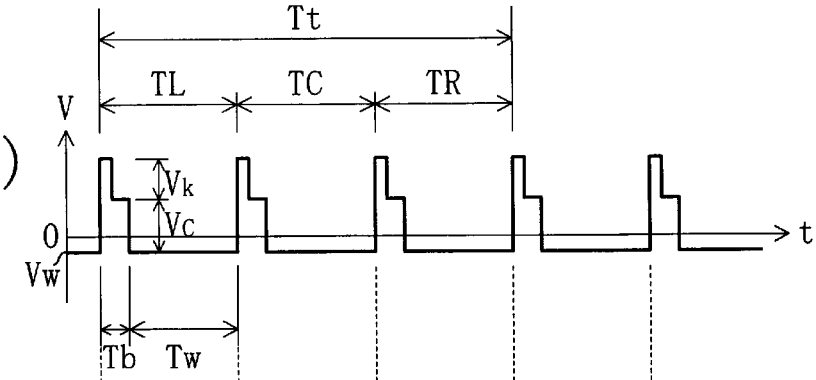
FIG. 3 include timing charts showing the waveforms of voltages applied to a control electrode and to a deflection electrode and a view showing the direction of a jumping toner.
Figure 3B:
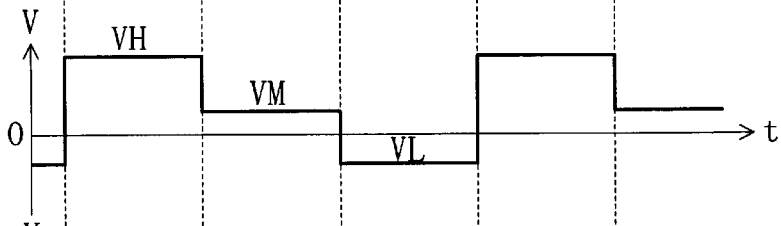
Figure 3C:
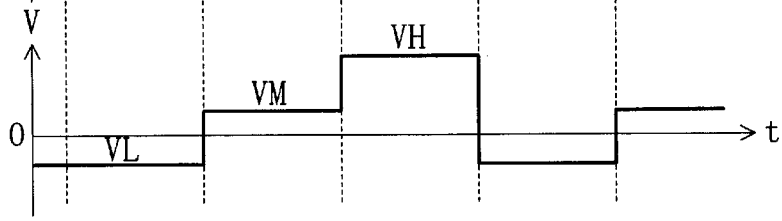
Figure 3D:
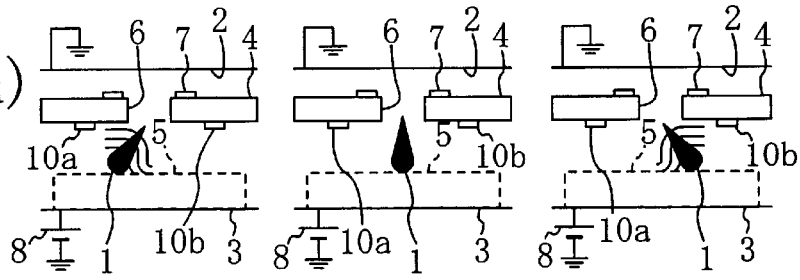

A description will be given next to the respective structures of the control electrode 7 and the deflection electrodes 10*a* and 10*b* each provided on the printhead 4 with reference to FIG. 2. FIG. 2 are plan views showing the electrodes provided on the surface of the printhead 5 and the toner passage hole 6 provided therein, of which FIG. 2(*a*) shows the control electrode 7 provided on the side of the printhead 4 closer to the toner holding member 2 and the toner passage holes 6 provided therein and FIG. 2(*b*) shows the control electrode 7 provided on the side of the printhead 4 closer to the rear electrode 3 and the toner passage holes 6 therein.

The diameter of the toner passage hole 6 shown in FIG. 2(*a*) is set to about 50 to 200 $\mu$m. The control electrode 7 is configured as a circle concentric to the toner passage hole 6 and having an inner diameter larger than the diameter of the toner passage hole 6 by about 5 to 30 $\mu$m. The width of the control electrode 7, which can be obtained as the difference between the outer and inner diameters of the control electrode 7, is adjusted to about 5 to 30 $\mu$m. Although each of the toner passage hole 6 and the control electrode 7 shown in FIG. 2(*a*) has a circular configuration, it may have an elliptic or oval configuration. The control electrode 7 need not surround the entire circumference of the toner passage hole 6. The control electrode 7 may also be provided upstream or downstream of the toner holding member 2 in the direction of rotation thereof.

14 denotes a lead wire connecting the control electrode 7 to the voltage source 9 for control electrode and provided on the printhead 4. A voltage pulse generated from the voltage source 9 for control electrode is supplied to the control electrode 7 via the lead wire 14.

As shown in FIG. 2(*b*), the deflection electrodes 10*a* and 10*b* are disposed obliquely to the direction of transportation of the image receiving member 5 indicated by the arrow A with the toner passage hole 6 interposed therebetween such that the toners are caused to jump sequentially in the oblique direction onto the image receiving member 5 being transported and eventually form a lateral line. If the straight line extending through the center of the toner passage hole 6 orthogonally to the direction of transportation of the image receiving member 5 is $I_1$ and the straight line connecting the centers of the deflection electrodes 10*a* and 10*b* to each other is $I_2$, the angle θ formed between the straight lines $I_1$ and $I_2$ is given by the following expression:

$$\tan \theta = 1/N$$

where N is the number of the tracks of the jumping toners. In an exemplary case as shown FIG. 3(*d*), the jumping toners form the three tracks of left, center, and right ones so that N=3 is satisfied. In the present embodiment, the toners form the three tracks, similarly to the case shown in FIG. 3(*d*), so that θ=18.3 degrees is satisfied. The deflection electrodes 10*a* and 10*b* are used commonly by the adjacent toner passage holes 6.

An antistatic electrode may also be provided on the outermost surface of the printhead 4. This prevents the toner particles from charging the printhead 4 in contact therewith. In addition, the amount of toner charge on the toner holding member becomes constant. A hard material such as conductive amorphous carbon is used preferably to compose the antistatic electrode for the suppression of friction resulting from direct contact between the image receiving member 5 and the toner particles. The surface resistance of the antistatic electrode is preferably in the range of $10^8$ Ω/□ to $10^{11}$ Ω/□. If the surface resistance is over the range, the effect of removing the charge is degraded. If the surface resistance is under the range, on the other hand, an electrical short circuit may occur between the antistatic electrode and the rear electrode 3.

FIGS. 3 show the waveforms of voltages applied to the control electrode 7 and to the deflection electrodes 10*a* and 10*b* and the direction in which the toner jumps, of which FIG. 3(*a*) is a timing chart showing the waveform of the voltage applied to the control electrode 7 and FIGS. 3(*b*) and 3(*c*) are timing charts showing the waveforms of the voltages applied to the deflection electrodes 10*a* and 10*b*. In each of FIGS. 3(*a*), 3(*b*), and 3(*c*), the vertical axis represents voltage and the horizontal axis represents time. FIG. 3(*d*) shows sequential deflection of the direction of the jumping toner. The reference numerals shown in FIG. 3(*d*) are the same as in FIGS. 1 and 2.

A description will be given first to FIG. 3(*d*). By applying different voltages from the deflection power sources 11*a* and 11*b* to the deflection electrodes 10*a* and 10*b* provided on the printhead 4, an electric field centering around the toner passage hole 6 loses symmetry so that the track of the jumping toner that has passed through the toner passage hole 6 is deflected from the center of the toner passage hole 6. As a result, the toner 1 is impacted on a position at a distance from the center axis of the toner passage hole 6 on the image receiving member 5 to form a dot. By applying the same voltages to the deflection electrodes 10*a* and 10*b*, the toner 1 is impacted on the center axis of the toner passage hole 6.

By thus controlling the deflection voltages applied to the deflection electrodes 10*a* and 10*b*, dots can be formed at a plurality of positions on the image receiving member 5 through the single toner passage hole 6. This allows a high-resolution toner image to be formed on the image receiving member 5 even if the toner passage holes 6 provided in the printhead 4 is small in number.

The left-hand portion of FIG. 3(*d*) shows the case where the voltage (VH) applied to the deflection electrode 10*a* positioned on the left side of the toner passage hole 6 relative to a direction orthogonal to the direction of transportation of the image receiving member 5 is higher than the voltage (VL) applied to the deflection electrode 10*b* positioned on the right side of the toner passage hole 6. As a result, the track of jumping of the negatively charged toner 5 is deflected leftward by an electrostatic field formed between the deflection electrodes 10*a* and 10*b* (hereinafter, the electric field formed between the deflection electrodes 10*a* and 10*b* will be referred to as a deflection electric field). The middle portion of FIG. 3(*d*) shows the case where the same voltages (VM) are applied to the deflection electrodes 10*a* and 10*b*. This causes the charged toner to move straight toward the image receiving member 5 to reach a position on the image receiving member 5 opposed to the position of the toner passage hole 6. The right-hand portion of FIG. 3(*d*) shows the case where the voltage (VH) applied to the right deflection electrode 10*b* is higher than the voltage (VL) applied to the left deflection electrode 10*a*. As a result, a deflection electric field oriented reversely to that shown in the left-hand portion of FIG. 3(*d*) is formed between the deflection electrodes 10*a* and 10*b* so that the track of jumping of the negatively charged toner 5 is deflected rightward.

The foregoing steps of deflecting the track of the jumping toner, i.e., the step of leftward deflection (hereinafter referred to as a leftward deflection step), the step of straight movement (hereinafter referred to as a straight movement step), and the step of rightward deflection (hereinafter referred to as a rightward deflection step) are repeated continuously with the transportation of the receiving member 5 so that a toner image is formed on the image receiving member 5. The period during which the leftward deflection step, the straight movement step, and the rightward deflection step are repeated will be referred to as an entire deflection step period. The distance between two dots formed on the image receiving member 5 in the leftward deflection step and in the straight movement step will be referred to as a leftward deflection distance and the distance between two dots formed on the image receiving member 5 in the rightward deflection step and in the straight movement step will be referred to as a rightward deflection distance.

In FIGS. 3(*a*) to 3(*c*), the period Tt shows a time required to form one line, which corresponds to the entire deflection step period. The period Tt is determined by a resolution in the direction of transportation of the image receiving member 5. If a lateral line with a pitch of, e.g., 300 dpi (dot/inch) is to be formed, a line pitch of about 84.6 μm is obtained by dividing 1 inch=25.4 mm by 300 dots. The image receiving member 5 moves appropriately by one pitch during the formation of one line. If the speed of the image receiving member 5 is assumed to be, e.g., 60 mm/s, the period Tt becomes about 1390 μs. In the present embodiment, the resolution is set to 600 dpi and the speed of transportation of the image receiving member 5 is set to 100 mm/s. Accordingly, the Tt period becomes 423 μs.

TL, TC, TR denote control voltage supply times required to control the formation of one dot by supplying voltages to the control electrode 7, of which TL is a control voltage supply time required to form one dot by the leftward deflection step and TC and TR are respective control voltage supply times for forming one dot by the straight movement step and the rightward deflection step.

In the present embodiment, the control voltage supply times are set to satisfy TL=TC=TR. Since Tt=423 μs is satisfied, TL=TC=TR=141 μs is satisfied. Each of the control voltage supply times TL, TC, and TR is composed of a pulse voltage width Tb or promoting the passage of the toner 1 through the toner passage hole 6 and a suppression period Tw for suppressing the passage of the toner 1 through the toner passage hole 6. The pulse voltage width Tb is variable in responsive to the image signal supplied from the outside. Specifically, Tb is adjusted to be short when dots at a low density are formed. When dots at a high density are formed, Tb is adjusted to be long. If the pulse voltage width Tb is adjusted to zero, the toner 1 cannot pass through the toner passage hole 6 so that a non-printed region is formed. This allows the formation of an image excellent in halftone property.

Tw is supplied during a period between the termination of Tb and the subsequent control voltage supply time. In the present embodiment, the variable range of Tb is set to 0 μs to 80 μs. The voltage Vw applied to the control electrode 7 during the suppression period Tw is adjusted to −50 V and the pulse width Vc is adjusted to 300 V. The voltage level Vw applied to the control electrode 7 during the suppression period Tw and the voltage Vc superimposed on the voltage level Vw during the period Tb are not limited to the foregoing values provided that an electric field suppressing or promoting the passage of the toner 1 through the toner passage hole 6 is formed between the toner holding member 2 and the printhead 4. Although the present embodiment has applied the suppression voltage Vw to the control electrode 7 during the suppression period Tw, the passage of the toner 1 through the toner passage hole 6 can also be suppressed during the period Tw if Vw is set to the ground level of the image forming apparatus and a voltage of the polarity opposite to that of the toner 1 is applied to the toner holding member 2.

Figures 4A, 4B, 4C:
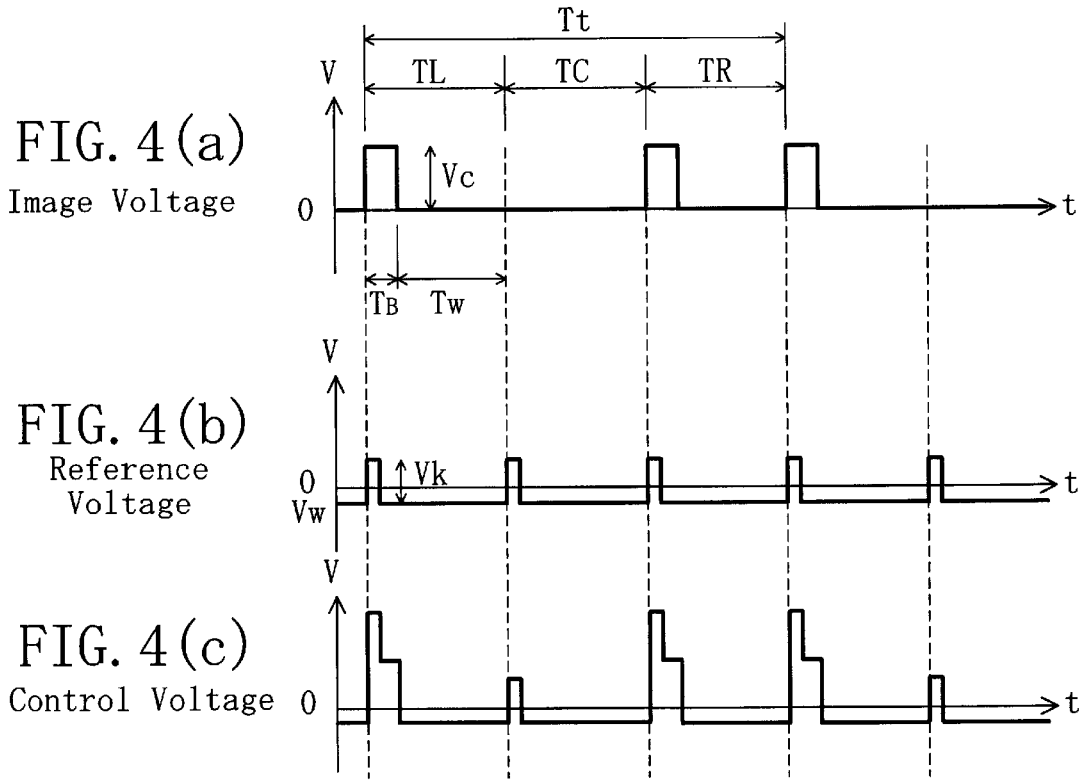
FIG. 4 are timing charts showing the waveforms of voltages applied to the control electrode.

The control voltage applied to the control electrode 7 will be described in detail with reference to FIGS. 4(*a*), 4(*b*), and 4(*c*). FIG. 4(*a*) is a timing chart showing the waveform of an image voltage applied to the control electrode 7. FIG. 4(*b*) is a timing chart showing the waveform of a reference voltage also applied to the control voltage 7.

As shown in FIG. 4(*a*), the pulse voltage Vc of the image voltage is set to 300 V and the variable range of the pulse voltage width Tb is set to 0 μs to 80 μs. If an image is recorded in response to an image signal, the pulse voltage Vc is applied to the control electrode 7. Conversely, if an image is not recorded, the pulse voltage Vc is not applied to the control electrode 7.

As shown in FIG. 4(*b*), the voltage level Vw of −50 V is applied as the reference voltage to the control electrode 7 during the suppression period Tw. The pulse voltage Vk of the reference voltage is set to 150 V, while the pulse voltage width is adjusted larger than zero and smaller than the pulse voltage width Tb of the image voltage. Such a pulse voltage Vk is applied periodically to the control electrode 7 during each control voltage supply time TL (=TC, TR).

The waveform of the control voltage is formed by combining the waveform of the image voltage with the waveform of the reference voltage. The timing chart for the control voltage is shown in FIG. 4(*c*). By thus forming the pulse voltage Vk, the toner 1 can easily be ejected from the toner holding member 2.

If a toner having the property of being easily desorbed from the toner holding member 2 is used, the pulse voltage Vk is preferably minimized and Vk is preferably 0 V or lower. This is because, even if the pulse voltage Vc is not applied, the toner may be desorbed from the toner holding member 2 due to the pulse voltage Vk to adhere to the periphery of the toner passage hole 6 or jump toward the opposing member.

As shown in FIGS. 3(*b*) and 3(*c*), the voltage sources 11*a* and 11*b* for deflection electrodes which supply respective deflection voltages to the deflection electrodes 10*a* and 10*b* are capable of outputting the three voltage levels VL, VM, and VH and switch among the deflection voltage levels in synchronization with the control voltage supply time required to form one dot. By way of example, the present embodiment assumes that VL=−50 V, VM=+50 V, VH=+150 V are satisfied.

A description will be given to the outline of an image forming operation performed by the image forming apparatus with reference to FIGS. 1 to 3. First, the toner holding member 2 rotates and the toner 1 is transported to a position opposing the toner passage hole 6. A voltage of +1000 V is applied preliminarily from the voltage source 8 for rear electrode to the real electrode 3, while a voltage of −50 V is applied simultaneously to the control electrode 7. The voltage supplied from the voltage source 8 for rear electrode blocks an electrostatic field formed between the toner holding member 2 and the rear electrode 3 so that the toner 1 remains held on the toner holding member 2.

Then, the image receiving member 5 is transported to a position opposing the toner passage hole 6, i.e., a position at which printing is executed. At the same time as the image receiving member 5 is transported to the printing execution position, a specified pulse voltage as shown in FIG. 3 is supplied selectively from the voltage source 9 for control electrode to the control electrode 7. As a result, an adsorption electric field which adsorbs the toner 1 on the toner holding member 2 toward the control electrode 7 supplied with the pulse voltage is formed between the toner holding member 1 and the control electrode 7. The toner 1 desorbed from the toner holding member 2 by the adsorption electric field is further adsorbed by an electric field formed between the toner holding member 2 and the rear electrode 3 to enter the toner passage hole 6.

In synchronization with the pulse voltage applied to the control electrode 7, specified voltages are applied from the voltage sources 11*a* and 11*b* for deflection electrodes to the deflection electrodes 10*a* and 10*b*, whereby the track of the jumping toner 1 that has passed through the toner passage hole 6 is deflected by a deflection electric field distorted in the vicinity of the deflection electrodes 10*a* and 10*b*. After the track of jumping is deflected, the toner is electrostatically adsorbed by the rear electrode 3 to be impacted on the moving image receiving member 5 and form a dot. The image receiving member 5 formed with the dot is transported to fixing means not shown so that the toner on the image receiving member 5 is heat-fused by the fixing means to be fixed onto the image receiving member 5. After the fixing step is completed, the image receiving member 5 is discharged from the image forming apparatus to the outside and a toner image fixed to the image receiving member 5 is finally obtained.

Figure 5:
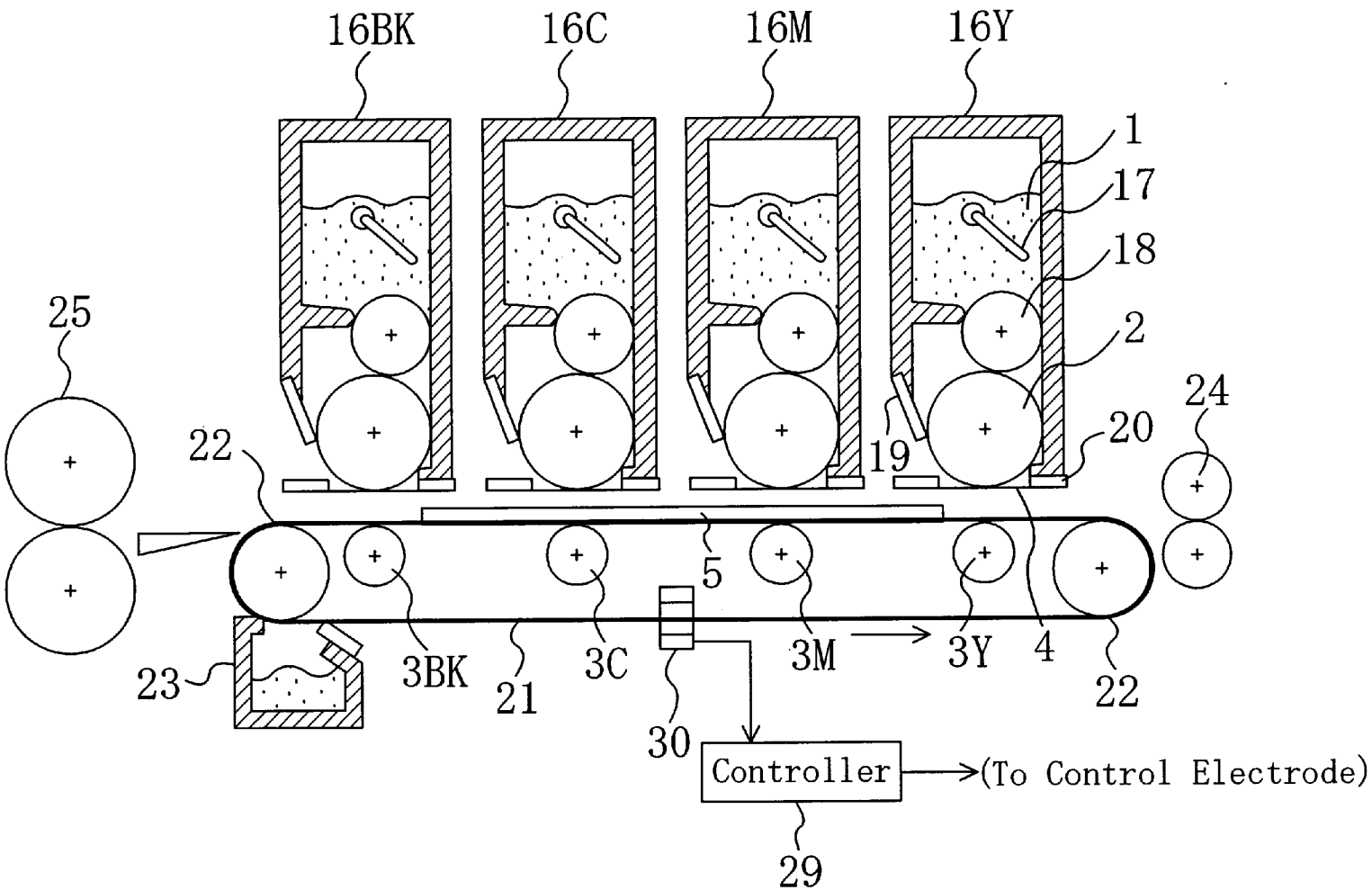
FIG. 5 is a cross-sectional view schematically showing a structure of the image forming apparatus according to EMBODIMENT 1 of the present invention.

A description will be given next to the image forming apparatus according to EMBODIMENT 1 of the present invention with reference to FIG. 5. FIG. 5 is a cross-sectional view schematically showing a structure of the image forming apparatus using the printhead 4 according to EMBODIMENT 1 of the present invention. In FIG. 5, 16Y, 16M, 16C, and 16BK denote toner supplying units for different colors which are arranged along the direction of transportation of the image receiving member 5 in the order of yellow, magenta, cyan, and black. Each of the toner supplying units 16Y, 16M, 16C, and 16BK is composed of the toner 1, the toner holding member 2, a stirring member 17 for stirring the toner 1, a toner supplying member 18 for supplying the toner 1 to the toner holding member 2, a toner layer regulating member 19 for forming a toner layer on the toner holding member 2, the printhead 4, and a printhead holder 20 for holding the printhead 4.

The printhead 4 has a cross-sectional configuration such that the inner diameter of the toner passage hole 6 is larger at a position closer to the toner holding member 2 than at a position closer to the rear electrode 3, as described above. It is also possible to use a structure in which the printheads 4 and the printhead holders 20 are separated from the toner supplying units 16Y, 16M, 16C, and 16BK. Preferably, the toner supplying units 16Y, 16M, 16C, and 16BK are configured removably from the main body of the image forming apparatus. This is because the configuration facilitates the supply of the toners to the toner supplying units 16Y, 16M, 16C, and 16BK and the maintenance of the printheads 4 and the other components.

21 denotes a transportation belt for holding and transporting the image receiving member 5, which is composed of a resin sheet having a moderately high resistivity. 22 denotes a belt driving roller around which the transportation belt 21 is wound to be rotatively driven. On the back surface of the transportation belt 21, rear electrodes 3Y, 3M, 3C, and 3BK are arranged in opposing relation to the respective toner supplying units for different colors.

Although the rear electrodes 3Y, 3M, 3C, and 3BK for different colors are configured as rollers, the configurations thereof are not limited thereto. It is also possible to provide conductive plates or conductive elastic blades such that they are pressed onto the back surface of the transportation belt 21. 23 denotes a belt cleaning unit for removing the toner adhered to a surface of the transportation belt 21. 24 denotes a resist roller for supplying the image receiving member 5 onto the transportation belt 21, while adjusting the supply timing. 25 denotes a fixing unit for fixing the toner image formed on the image receiving member 5.

Figure 6:
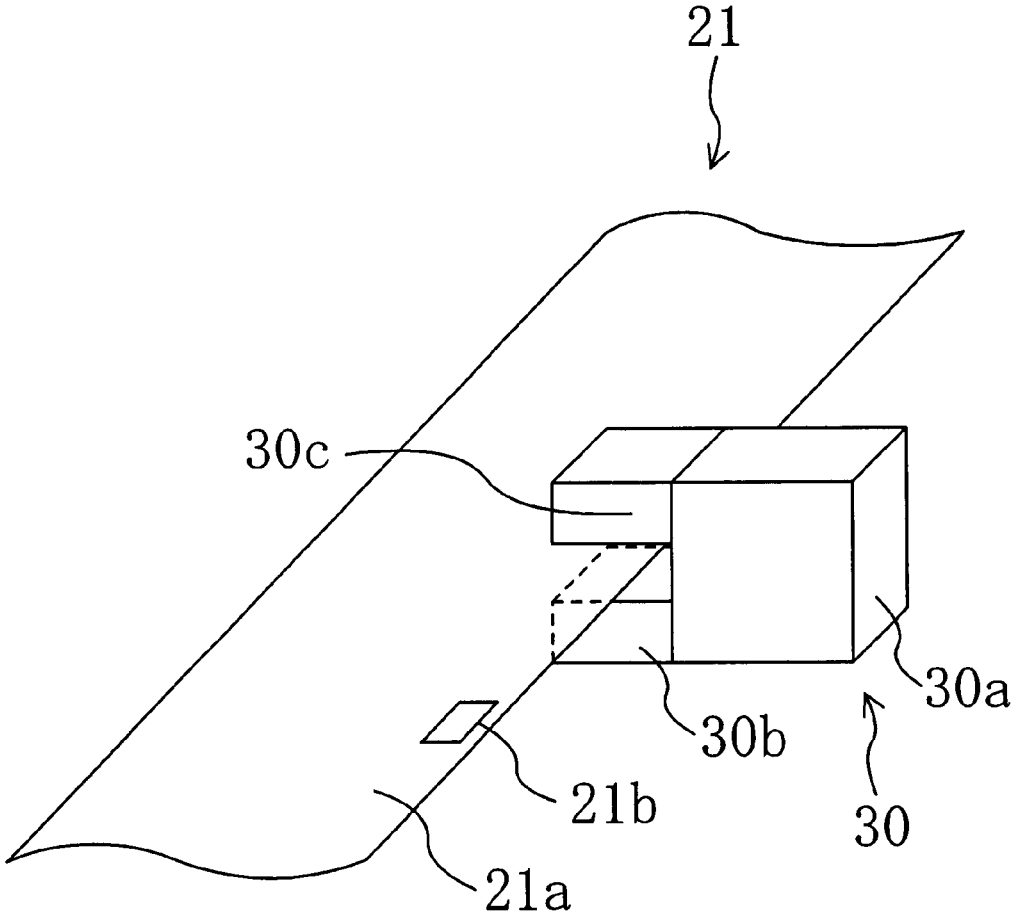
FIG. 6 is a perspective view schematically showing a structure of a belt rotation sensor.

As shown in FIG. 6, the present image forming apparatus is provided with a belt rotation sensor 30 for detecting the rotation of the transportation belt 21, which is composed of a photomicrosensor. The belt rotation sensor 30 consists of a sensor main body 30*a*, a light projector 30*b*, and a light receiver 30*c*. The light projector 30*b* and the light receiver 30*c* are configured to extend from the sensor main body 30*a* and opposed to each other with a given distance provided therebetween.

A belt edge portion 21*a* which is the side edge portion of the transportation belt 21 is formed with a through hole 21*b*. The belt rotation sensor 30 is disposed in the vicinity of the transportation belt 21 such that the through hole 21*b* passes through the space between the light projector 30*b* and the light receiver 30*c*. The belt rotation sensor 30 according to the present embodiment is not limited to the foregoing structure. The belt rotation sensor 30 may also have another structure for detecting the rotation of the belt.

The present image forming apparatus has a controller 29 for controlling the voltage applied to the control electrode 7 based on a detection signal from the belt rotation sensor 30 and thereby controlling the initiation of the ejection of the toner from each of the toner holding members 2.

Figure 7:
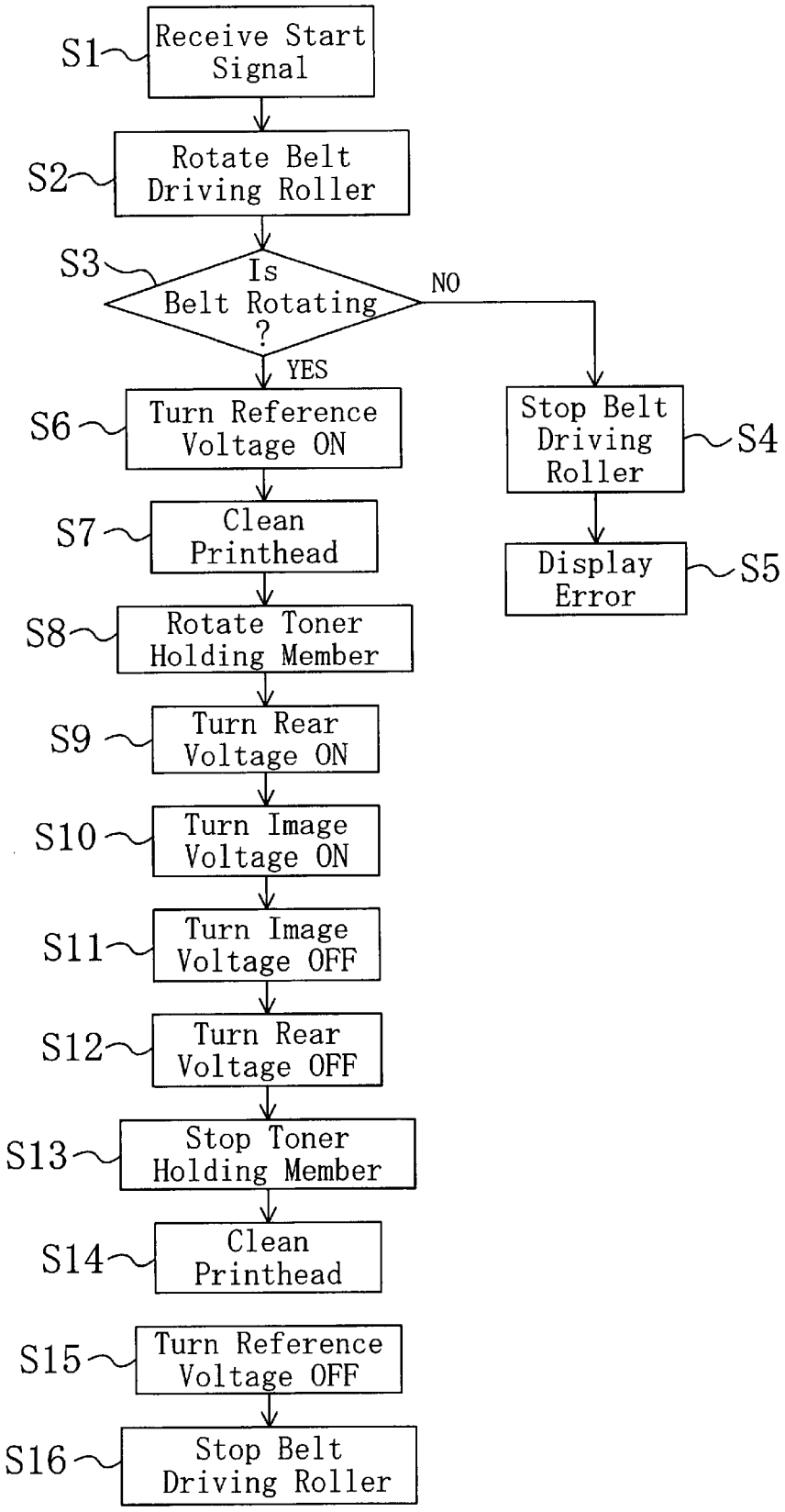
FIG. 7 is a flow chart illustrating an image forming operation according to EMBODIMENT 1 of the present invention.
Figure 8:
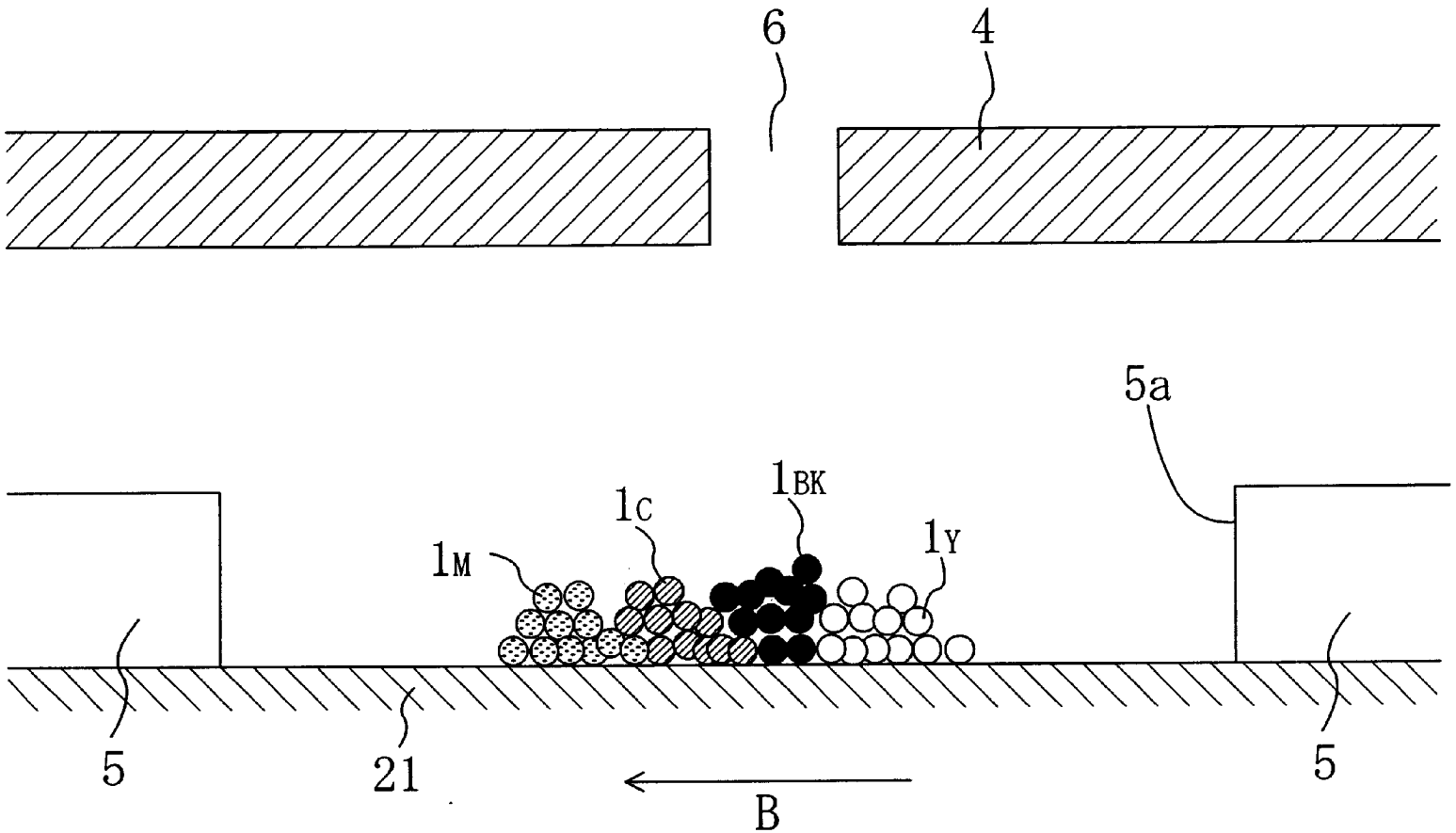
FIG. 8 is a view showing the deposition of a color toner according to EMBODIMENT 1 of the present invention.

A description will be given to an image forming operation performed by the image forming apparatus according to EMBODIMENT 1 of the present invention by using the flow charts of FIGS. 5 and 7. First, in Step S1, image signals from the outside are accumulated in the image forming apparatus. After the accumulation of the image signals is completed, the whole step moves to Step S2. In Step S2, inputting to the sensor is initiated by projecting light from the light projector 30*b* of the belt rotation sensor 30. Then, the rotative driving of the transportation belt 21, the belt driving roller 22, and the fixing unit 25 is initiated and the whole process moves to Step S3.

In Step S3, it is determined whether or not the transportation belt 21 is rotating normally. The determination is performed based on the result of detection performed by the belt rotation sensor 30. If the through hole 21*b* is not present in the space between the light projector 30*b* and the light receiver 30*c* of the belt rotation sensor 30, the light from the light projector 30*b* is cut off by the belt edge portion 21*a* of the transportation belt 21 so that the light is not received by the light receiver 30*c* light. If the through hole 21*b* passes through the space between the light projector 30*b* and the light receiver 30*c*, the light from the light projector 30*b* is received by the light receiver 30*c* so that the belt rotation sensor 30 outputs a signal. If the signal is outputted in a given cycle, it is determined that the transportation belt 21 is rotating normally.

If it is determined in Step S3 that the transportation belt 21 is not rotating normally, the whole process moves to Step S4 where the belt driving roller 22, the transportation belt 21, and the fixing unit 25 are halted. Then, the whole process moves to Step S5 where the image forming apparatus displays an error and is stopped.

If it is determined in Step S3 that the transportation belt 21 is rotating normally, the whole process moves to Step S6 where the aforesaid reference voltage composing the control voltage is applied to the control electrode 7. This forms a specified electric field between the control electrode 7 around the toner passage hole 6 of each of the printheads 4 and the corresponding toner holding member 2. Next, in Step S7, voltages lower than the rear voltages applied to the rear electrodes 3Y, 3M, 3C, and 3BK during image formation are applied thereto to form an electric field lower in intensity than the electric field formed during image formation between the printheads 4 and the transportation belt 21 and thereby reclaim the toners 1 reliably. It is also possible to reduce the intensity of the electric field and produce a specific state in which the intensity of the electric field is zero.

With the electric field being formed, head cleaning for cleaning the toner passage holes 6 by ejecting the toners 1 on the toner holding members 2 to the transportation belt 21 through the toner passage holes 6 of the printheads 4 is performed. Specifically, the controller 29 applies the pulse voltage for cleaning the printheads 4 to the control electrodes 7 upon receiving a detection signal from the belt rotation sensor 30 and causes the toner adhered to the toner passage holes 6 to be ejected therefrom. At this time, the impact position of the yellow toner 1Y which is the palest one of the toners 1Y, 1M, 1C, and 1BK in the different colors of yellow, magenta, cyan, and black ejected through the toner passage holes 6 is positioned closer to a tip portion of an image formation region on the transportation belt 21 in the direction of movement (the direction indicated by the arrow B in the drawing) of the image receiving member 5 than the impact positions of the other magenta, cyan, and black toners 1M, 1C, and 1BK. After the printheads 4 are cleaned, the whole process moves to Step S8.

In Step S8, the supply of the toners to the printheads 4 is initiated by initiating the rotation of the toner holding member 2 and then the whole process moves to Step S9. In Step S9, the rear voltages for image formation are supplied to the rear electrodes 3 for different colors. On the other hand, the image receiving member 5 is transported from a sheet feed cassette not shown to the resist roller 24 to move onto the transportation belt 21 with a specified timing.

Then, when the image receiving member 5 is transported to a position opposing the toner supplying unit 16Y in Step S10, the controller 29 initiates, based on a detection signal from the belt rotation sensor 30, the application of the image voltage corresponding to the image signal from the outside to the control electrode 7 of the printhead 4 provided in the unit 16Y. Responsively, the toner on the toner holding member 2 of the unit 16Y passes through the toner passage hole 6 provided in the printhead 4 to reach the surface of the image receiving member 5. The image receiving member 5 held on the transportation belt 21 moves consistently thereon and the specified voltage is supplied sequentially to the control electrode 7, whereby a toner image is formed by the yellow toner on the image receiving member 5.

When the image receiving member 5 is transported to the position opposing the toner supplying unit 16M, the same process performed in the unit 16Y is performed so that a magenta toner image is superimposed on the yellow toner image on the image receiving member 5. The same process is also performed in the toner supplying units 16C and 16BK so that color toner images in four colors are formed eventually on the image receiving member 5. The image receiving member 5 holding the color toner images is separated from the transportation belt 21 to enter the fixing unit 25. In the fixing unit 25, the color toner images are fixed onto the image receiving member 5 so that the image receiving member 5 is discharged therefrom into a sheet discharge tray not shown.

By the foregoing process, a color image is printed on the image receiving member 5. In the toner supplying units 16Y, 16M, 16C, and 16BK for different colors through which the image receiving member 5 has passed, the application of the image voltages is stopped successively in Step S11. After that, the supply of the voltages to the rear electrodes 3 is also stopped in Step S12. Then, the whole process moves to Step S13 where the rotative driving of the toner holding member 2 is stopped and then moves to Step S14.

In Step S14, head cleaning similar to that performed in Step S7 is performed again with respect to each of the printheads 4. Then, in Step S7, the supply of low voltages that have been applied to the rear electrodes 3 is stopped, whereby the electric field between the printheads 4 and the transportation belt 21 is extinguished. Then, in Step S15, the application of the reference voltage to the control electrode 7 of each of the printheads 4 is halted. As a result, the electric field formed between the control electrodes 7 and the toner holding member 2 is extinguished.

Meanwhile, the transportation belt 21 from which the image receiving member 5 was separated is cleaned by the belt cleaning unit 23 and the toner 1 adhered to the surface of the transportation belt 21 is removed from the surface of the belt.

When the surface of the transportation belt 21 opposed to the toner supplying units for different colors passes through at least the cleaning unit 23 in Step S16, the rotation of the belt driving roller 22 is stopped and the rotative driving of the transportation belt 21 is stopped. The driving of the fixing unit is also stopped, whereby the printing operation performed by the image forming apparatus according to EMBODIMENT 1 of the present invention is completed.

Figure 9:
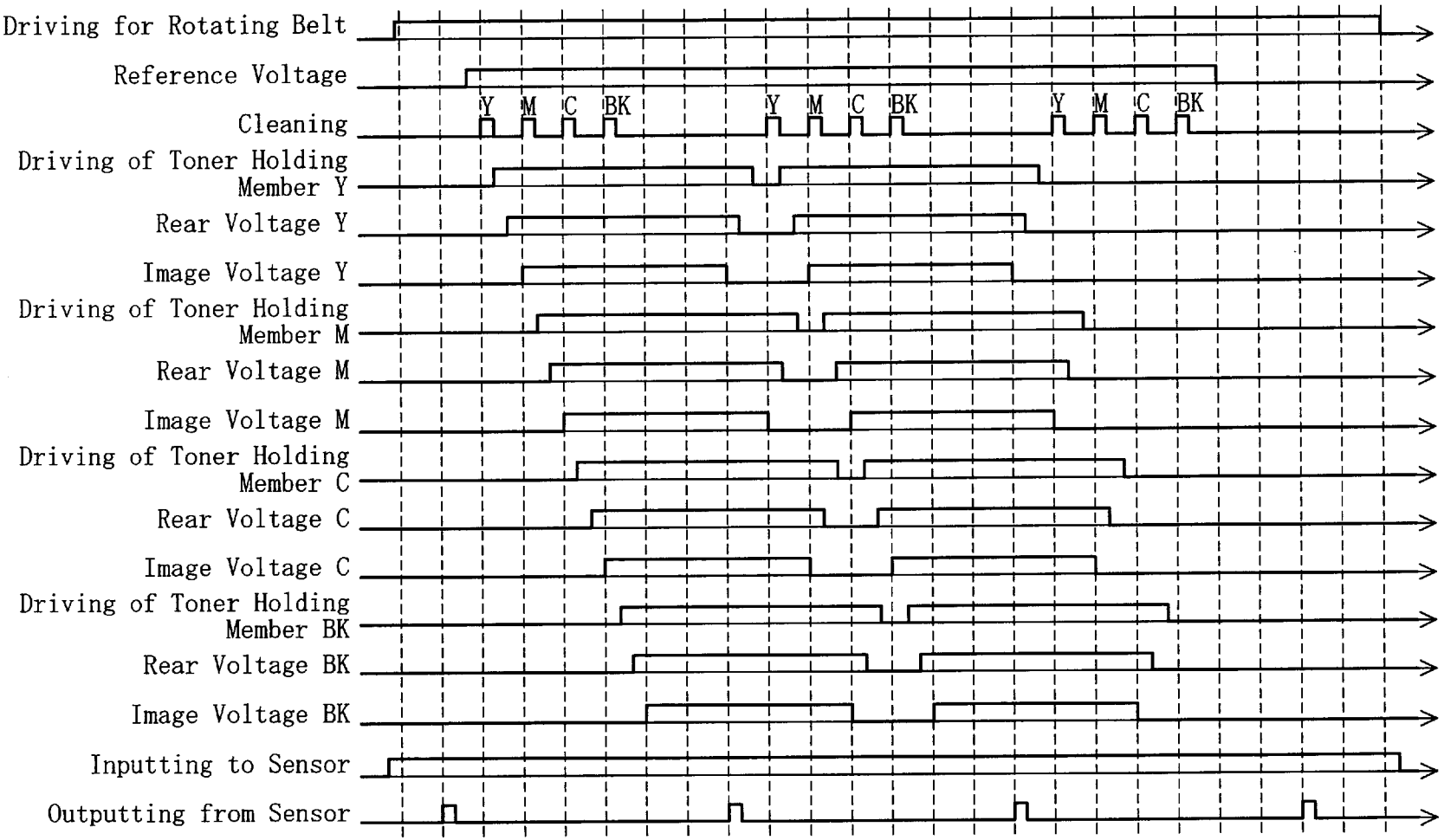
FIG. 9 is a timing chart showing the image forming operation according to EMBODIMENT 1 of the present invention.

The image forming operation performed by the image forming apparatus will further be described with reference to FIG. 5 and the timing chart of FIG. 9. First, the driving of the belt driving roller 22 is initiated by projecting light from the light projector 30*b* of the belt rotation sensor 30 toward the light receiver 30*c*. After that, if the light receiver 30*c* of the belt rotation sensor 30 detects the light from the light projector 30*b*, the reference voltage is applied to the control electrode 7. Then, cleaning is performed first by ejecting the toner 1 through the toner passage hole 6 of the printhead 4 of the yellow toner supplying unit 16Y.

After the cleaning of the printhead 4 is completed, the toner holding member 2 of the toner supplying unit 16Y is driven. After the driving of the toner holding member 2, the rear voltage is supplied to the rear electrode 3Y. Thereafter, the image voltage is applied to the control electrode 7 so that an image is formed.

The magenta printhead 4 is cleaned after a lapse of a specified time from the completion of the cleaning of the yellow printhead 4. Subsequently, the same printing operation as the yellow printing operation is also performed continuously in the magenta toner supplying unit 16M concurrently with the yellow printing operation. Likewise, cyan and black printing operations are performed concurrently with the yellow printing operation.

Thus, in the present embodiment, the toner 1 is ejected to the transportation belt 21 through each of the toner passage holes 6 to clean the toner passage hole 6 before the toner 1 is supplied to the vicinity of the toner passage hole 6 by rotatively driving the corresponding toner holding member 2.

Prior to the cleaning of the toner passage hole 6, an electric field is formed between the control electrode 7 around the toner passage hole 6 of the printhead 4 and the toner holding member 2.

Prior to the formation of the electric field between the control electrode 7 and the toner holding member 2, the movement of the transportation belt 21 is initiated.

Since the transportation belt 21 is allowed to move, the toner 1 ejected during the cleaning of the toner passage hole 6 is prevented from being deposited at a localized point on the transportation belt 21. This keeps the toner 1 on the transportation belt 21 from contact with the printhead 4 and prevents the clogging of the toner passage hole 6.

Since the impact positions of the toners 1 from the plurality of printheads 4 are dispersed, the contact of the toners 1 with the printheads 4 and clogging due to local increases in the amounts of deposited toners can be prevented.

If the toners 1 are ejected by, e.g., a method of applying an ultrasonic wave or a method of bringing the toner holding member 2 onto the printhead 4, the toners 1 impacted on the transportation belt 21 are scattered to the peripheries of the impact positions. If the scattered toners 1 enter the image formation region on the transportation belt 21 in which the image receiving member 5 is disposed, the upper and lower end portions of the image receiving member 5 are contaminated by the scattered toners 1. By causing the palest one, such as yellow, of the toners 1 in the plurality of colors to be impacted on a position in closest proximity to the while image receiving member 5, contamination is inconspicuous even if the toners 1 enter the image formation region.

Part of the scattered toners 1 float in the space between the printheads 4 and the transportation belt 21 to be impacted again on the transportation belt 21. Of the end portions of the image formation region, therefore, the tip portion 5*a* of the image formation region in the direction of movement of the transportation belt 21 is most likely to suffer contamination. By causing the palest one, such as yellow, of the toners 1 to be impacted on the tip portion 5*a* of the image receiving member 5, contamination at the tip portion 5*a* of the image receiving member 5 becomes inconspicuous.

The electrostatic field formed between the printheads 4 and the transportation belt 21 divides the toners 1 into those of a positive polarity and those of a negative polarity. This prevents the toners 1 of one of the positive and negative polarities from adhering to the surface of the printheads 4 and allows the toners 1 of the positive and negative polarities to reach the transportation belt 21 so that the efficiency with which the toners 1 are reclaimed is increased irrespective of the polarities of the toners 1.

By cleaning the printheads 4 with the toners 1 being supplied continuously, the ejection of the toners in large amounts is prevented. By halting the supply of the toners 1 in the cleaning step, the amounts of the toners 1 can be suppressed.

By forming the electric field for suppressing the supply of the toners 1 from the toner supplying members 1, the amount of the ejected toners 1 can be reduced.

Although the present embodiment has performed the ejection of the toners during the cleaning of the printheads 4 after the movement of the transportation belt 21 is initiated, the ejection of the toners is not limited to the period during which the printheads 4 are cleaned.

Although the yellow toner as the palest toner is positioned closer to the tip portion 5*a* of the image receiving member 5 in the direction of movement of the transportation belt 21 than the toners in the other colors, the yellow toner may also be positioned closer to the proximal portion of the image receiving member 5 in the direction of movement of the transportation belt 21 or the toners in the other colors may also be positioned closer to the tip portion 5*a* or the proximal end portion. If the image receiving member 5 is not white, the toner in a color close to the color of the image receiving member 5 is positioned closer to the tip portion 5*a* appropriately.

The cleaning of each of the printheads 4 may also be initiated after the rotation of the corresponding toner holding member 2. It is also possible to form an electric field between the control electrode 7 and the toner holding member 2 after the cleaning of the printhead 4.

Although the foregoing embodiment has used a dry toner as a developer, other toners including a wet toner having toner particles dispersed in a fluid dispersion and a liquid ink having a pigment or dye dispersed therein may also be used.

Although the present embodiment has applied the reference voltage to the control electrode 7, it is also possible to apply a voltage of the polarity opposite to that of the reference voltage to the toner holding member 2. In this case, a voltage outputted from the voltage source 9 for control electrode is required to have only the positive polarity. This prevents an increase in the size of the voltage source 9 for control electrode and an intricate process of designing an IC or transistor for switching the voltage to the control electrode 7 between the ON/OFF states. If an antistatic electrode is provided on the outermost surface of the printhead 4, the same effects are achievable by applying the reference voltage to the antistatic electrode instead of applying it to the control electrode 7.

Although the foregoing embodiment has performed head cleaning between the plurality of image receiving members 5, head cleaning need not be performed between each consecutive two of the image receiving members 5 and may be performed as required. For example, the image forming apparatus may be internally equipped with a counter for counting the number of times that the receiving members 5 pass through the positions opposing the printheads 4 so that head cleaning is performed when the number of times reaches a specified value. Head cleaning may also be performed immediately after a power supply for the apparatus is turned ON or during a stand-by period.

Embodiment 2

Figure 10:
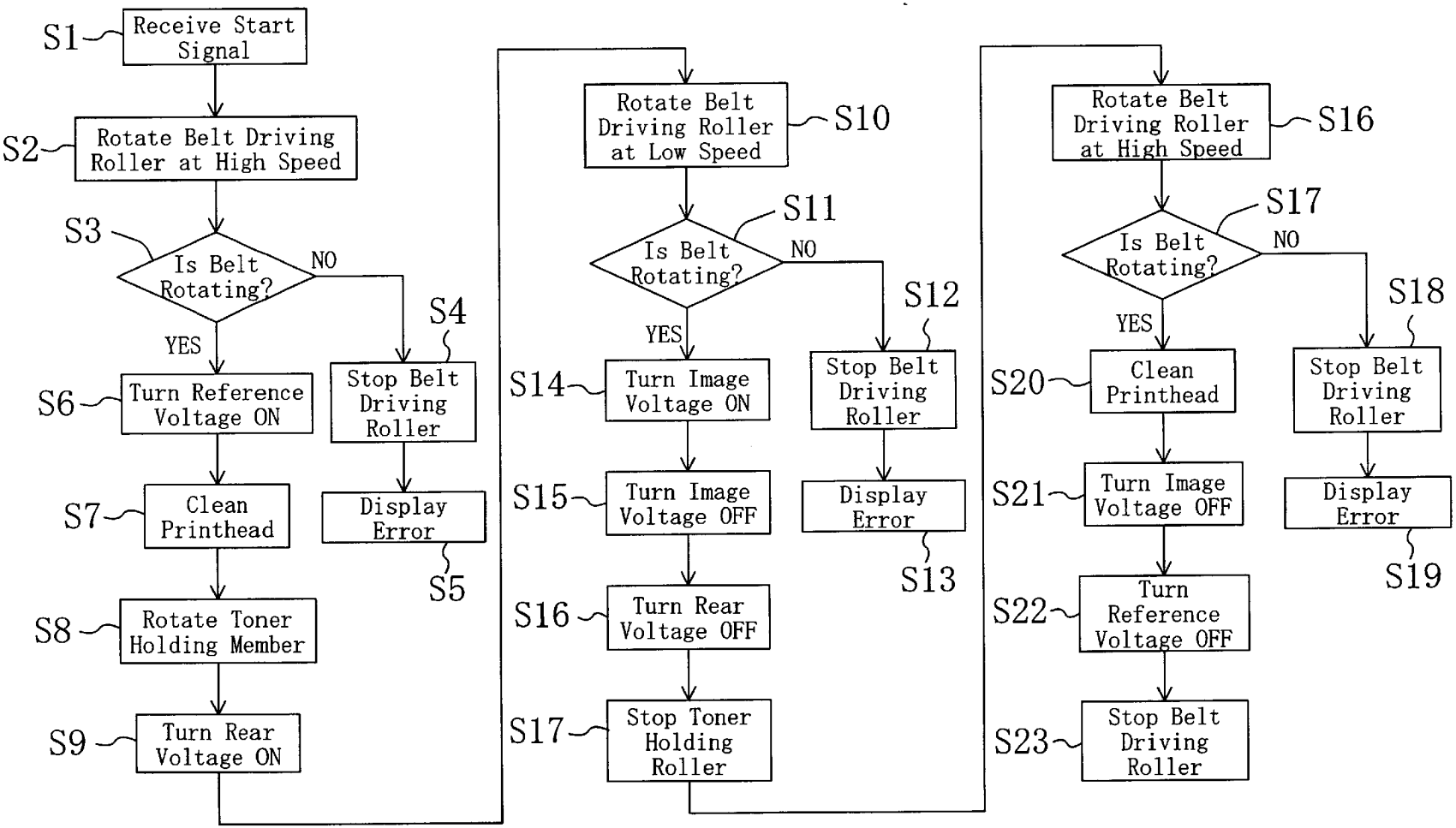
FIG. 10 is a flow chart showing an image forming operation according to EMBODIMENT 2 of the present invention.
Figure 11:
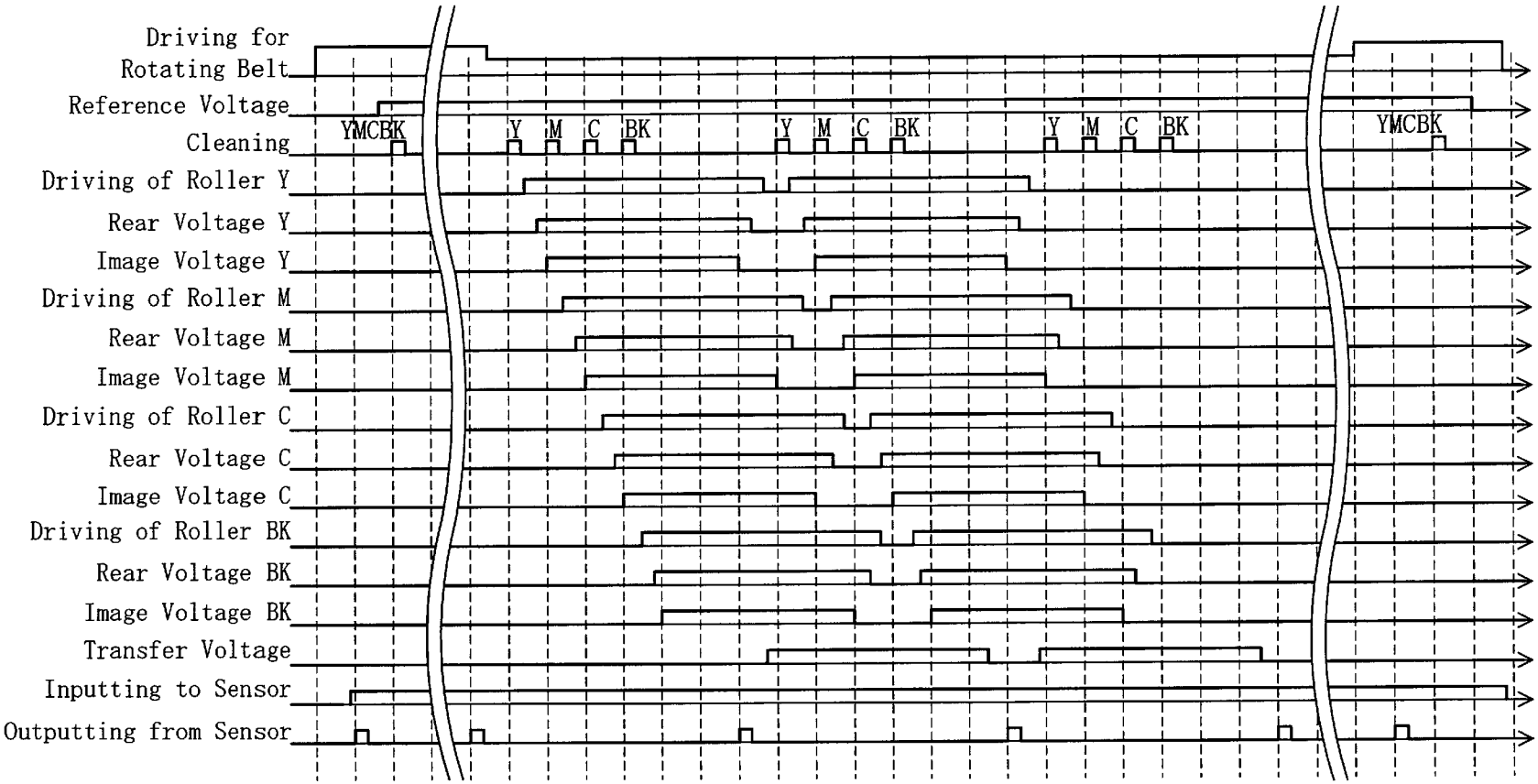
FIG. 11 is a timing chart showing the image forming operation according to EMBODIMENT 2 of the present invention.
Figure 12:
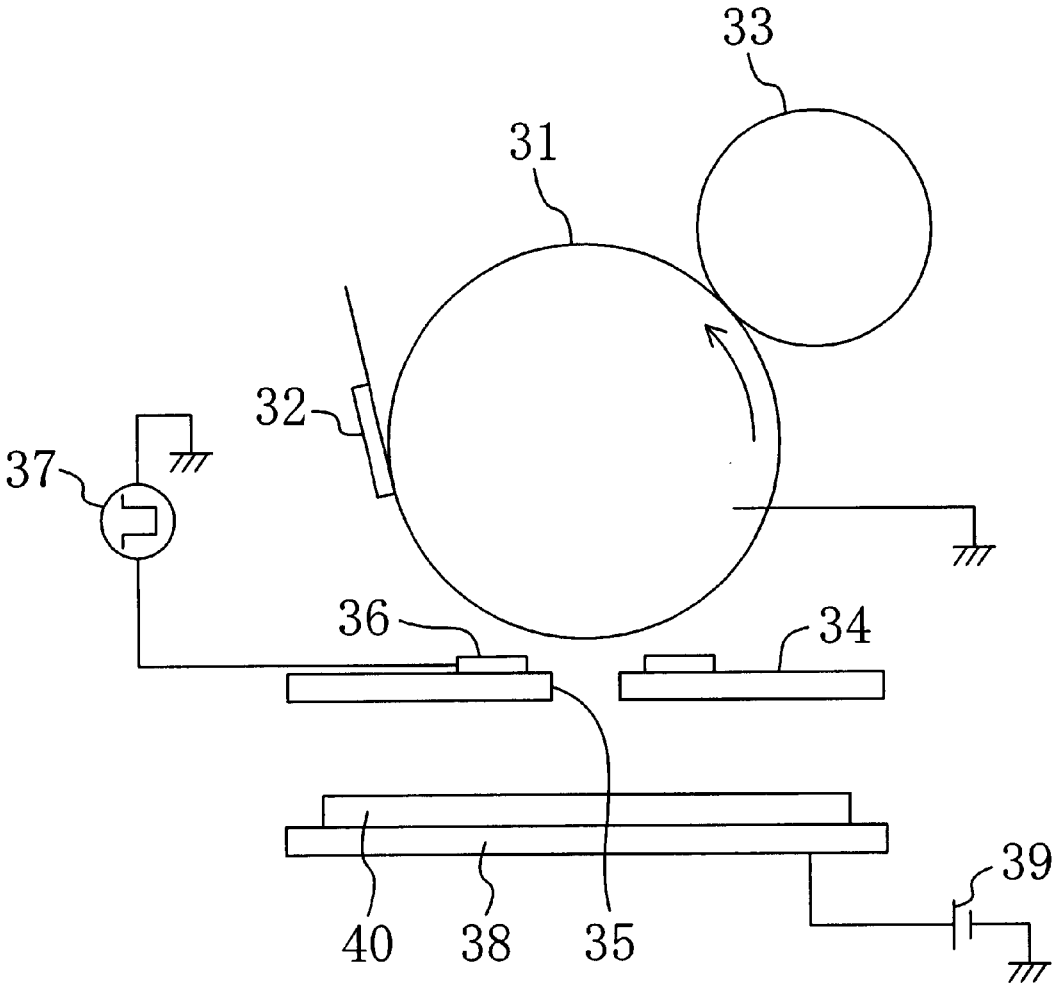
FIG. 12 is a structural view showing a principal portion of a conventional image forming apparatus.
Figure 13:
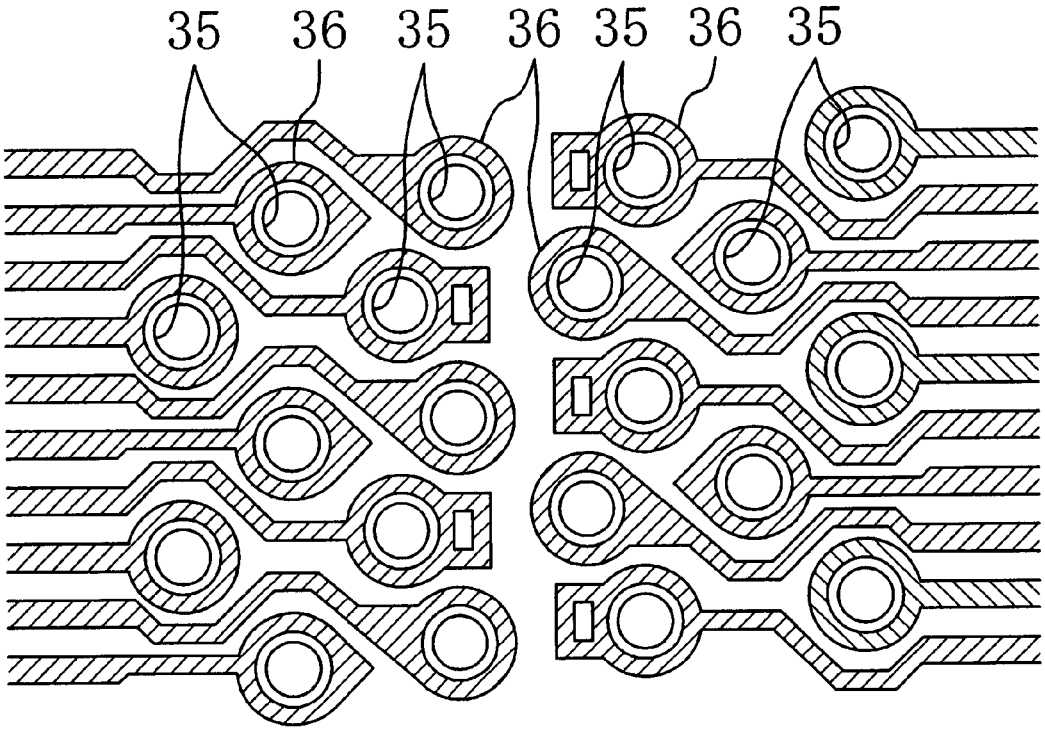
FIG. 13 is a view showing the arrangement of toner passage holes in a printhead.
Figure 14:
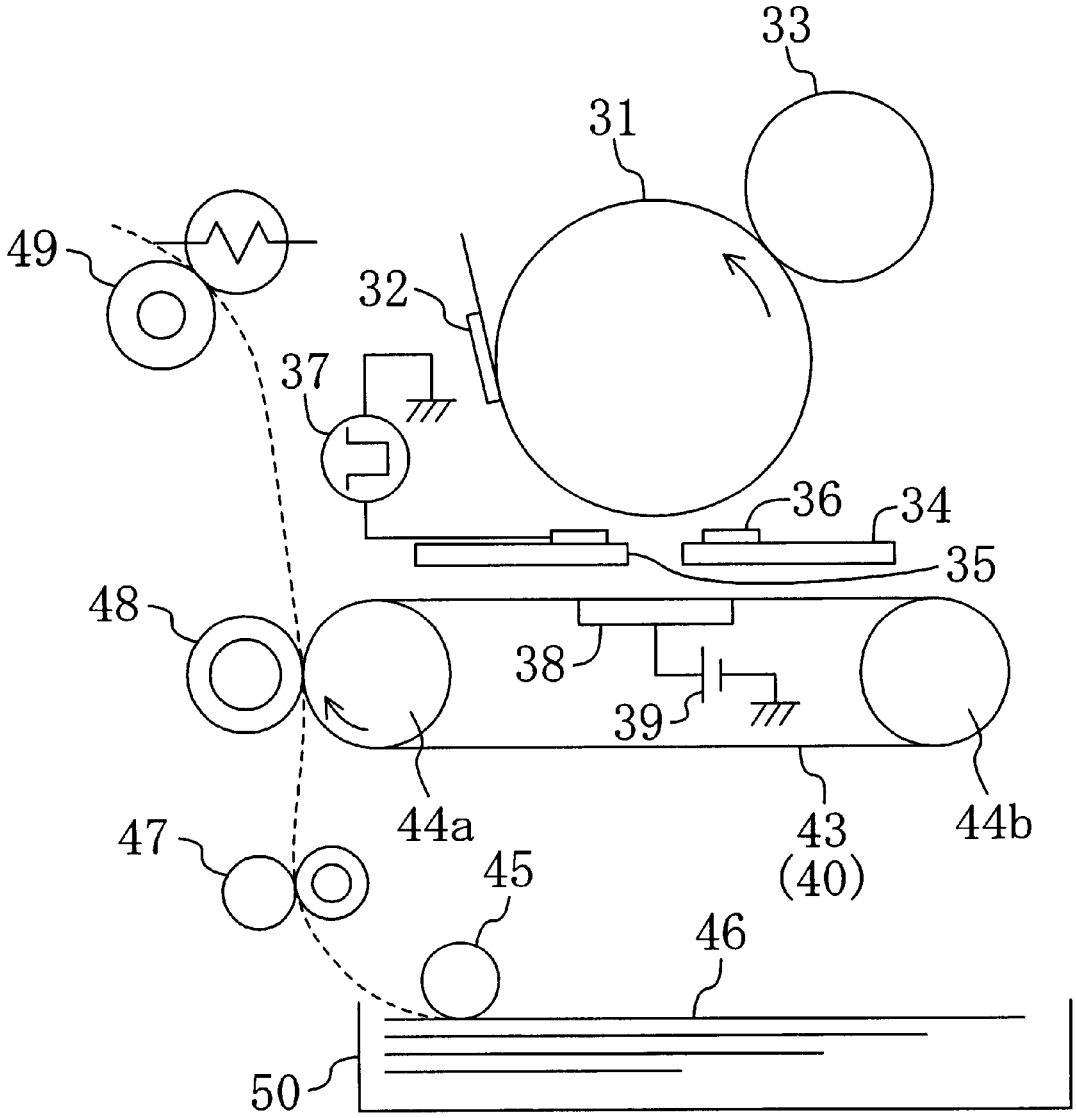
FIG. 14 is a structural view showing an overall structure of the conventional image forming apparatus.

Referring to FIGS. 10 and 11, EMBODIMENT 2 of the present invention will be described.

The present embodiment is different from EMBODIMENT 1 in that, in the printhead cleaning step performed before the image forming step is initiated or after the image forming step is completed when a plurality of sheets are to be printed, larger amounts of toners are ejected even in the image forming step than in the head cleaning step. The present embodiment is also different from EMBODIMENT 1 in that the speed of movement of the opposing member is increased accordingly in the head cleaning step performed before the image forming step is initiated or after the image forming step is completed. As for the components, they are the same as in EMBODIMENT 1.

A description will be given herein below to an image forming operation by using the flow chart shown in FIG. 10 and the timing chart shown in FIG. 11.

First, in Step S1, image signals from the outside are accumulated in the image forming apparatus. After the accumulation of the image signals is completed, the whole step advances to Step S2. In Step S2, inputting to the sensor is initiated by projecting light from the light projector 30*b* of the belt rotation sensor 30. Then, the rotative driving of the transportation belt 21, the belt driving roller 22, and the fixing unit 25 is initiated. The belt driving roller 22 is rotated such that the moving speed of the transportation belt 21 it this time is higher than during an image formation period, which will be described later. Preferably, the ratio of the moving speed of the belt at this time to the moving speed of the belt during the image formation period is determined to be equal to the ratio of the amounts of the ejected toners at this time to the amounts of the ejected toners during the image formation period. Specifically, a ratio of about 1.5 to 2 is preferred. Thereafter, the whole process moves to Step S3.

In Step S3, it is determined whether or not the transportation belt 21 is rotating normally. The determining means is the same as in the foregoing embodiment. If it is determined in Step S3 that the transportation belt 21 is not rotating normally, the whole process moves to Step S4 where the belt driving roller 22, the transportation belt 21, and the fixing unit 25 are halted. Then, the whole process moves to Step S5 where the image forming apparatus displays an error and is stopped.

If it is determined in Step S3 that the transportation belt 21 is rotating normally, the whole process moves to Step S6 where the aforesaid reference voltage composing the control voltage is applied to the control electrode 7. This forms a specified electric field between the control electrode 7 around the toner passage hole 6 of each of the printheads 4 and the corresponding toner holding member 2. In the subsequent Step S7, voltages lower than the rear voltages applied to the rear electrodes 3Y, 3M, 3C, and 3BK during image formation are applied thereto to form an electric field lower in intensity than the electric field formed during image formation between the printheads 4 and the transportation belt 21 and thereby reclaim the toner 1 reliably. It is also possible to reduce the intensity of the electric field and produce a specific state in which the intensity of the electric field is zero.

With the electric field being formed, head cleaning for cleaning the toner passage holes 6 by ejecting the toners 1 on the toner holding member 2 to the transportation belt 21 through the toner passage holes 6 of the printheads 4 is performed. Specifically, the controller 29 applies the pulse voltage for cleaning the printheads 4 to the control electrodes 7 upon receiving a detection signal from the belt rotation sensor 30 and causes the toners in the different colors adhered to the toner passage holes 6 to be ejected simultaneously therefrom. The amounts of the toners ejected at that time are controlled to be larger than those ejected during the image formation period. Specifically, the amounts of the toners ejected at that time are controlled preferably to be about 1.5 to 2 times the amount of the toners ejected during the image formation period. If the ratio is under the range, the function of cleaning the toner passage holes 6 is degraded if the image forming apparatus is left unused for a long period of time or if environmental conditions change. If the ratio is over the range, the toners are wasted. In addition, the jumped toners and the deposited toners that have reached the printheads 4 are likely to cause in-apparatus contamination and clogging. The amounts of the ejected toners can be increased easily by elongating the period during which the voltages are applied to the control electrodes 7 or increasing the voltage levels. If the heads are cleaned by imparting mechanical vibrations to the printhead 4, the amplitudes of the vibrations of the heads are controlled appropriately to be larger. As described above, the toners in the different colors are preferably ejected simultaneously. This circumvents the deposition of the toners in the different colors in overlapping relation and thereby prevents the problems associated with the toners deposited in large amounts on the transportation belt, including the clogging of the toner passage holes 6.

After the printheads 4 are cleaned, the whole process moves to Step S8. In Step S8, the supply of the toners to the printhead 4 is initiated by initiating the rotation of the toner holding member 2 and then the whole process moves to Step S9. In Step S9, the rear voltages for image formation are supplied to the rear electrodes 3 for different colors. On the other hand, the image receiving member 5 is transported from a sheet feed cassette not shown to the resist roller 24 to move to the transportation belt 21 with a specified timing.

For a transition to the image formation period, the movement of the transportation belt 21 is switched to a low speed in Step S10 and the whole process moves to Step S11 where it is determined whether or not the transportation belt 21 is rotating normally, similarly to Step S3. If it is determined that the transportation belt 21 is not rotating normally, the whole process moves to Step S12 where the belt driving roller 22, the transportation belt 21, and the fixing unit 25 are halted. Then, the whole process moves to Step S13 where the image forming apparatus displays an error and is stopped.

If it is determined in Step S11 that the transportation belt 21 is rotating normally, on the other hand, the whole process moves to Step S14. When the image receiving member 5 is transported to a position opposing the toner supplying unit 16Y in Step S14, the controller 29 initiates, based on a detection signal from the belt rotation sensor 30, the application of the image voltage corresponding to the image signal from the outside to the control electrode 7 of the printhead 4 provided in the unit 16Y. Responsively, the toner on the toner holding member 2 of the unit 16Y passes through the toner passage hole 6 provided in the printhead 4 to reach the surface of the image receiving member 5. The image receiving member 5 held on the transportation belt 21 moves consistently thereon and the specified voltage is supplied sequentially to the control electrode 7, whereby a toner image is formed by the yellow toner on the image receiving member 5.

When the image receiving member 5 is transported to the position opposing the toner supplying unit 16M, the same process performed in the unit 16Y is performed so that a magenta toner image is superimposed on the yellow toner image on the image receiving member 5. The same process is also performed in the toner supplying units 16C and 16BK so that color toner images in four colors are formed eventually on the image receiving member 5. The image receiving member 5 holding the color toner images is separated from the transportation belt 21 to enter the fixing unit 25. In the fixing unit 25, the color toner images are fixed onto the image receiving member 5 so that the image receiving member 5 is discharged therefrom into a sheet discharge tray not shown.

By the foregoing process, a color image is printed on the image receiving member 5. In the toner supplying units 16Y, 16M, 16C, and 16BK for different colors through which the image receiving member 5 has passed, the application of the image voltages is stopped successively in Step S11. After that, the supply of the voltages to the rear electrodes 3 is also stopped in Step S14. Then, the whole process moves to Step S15 where the rotative driving of the toner holding member 2 is stopped and then to Step S16.

For a transition to the printhead cleaning period, the movement of the transportation belt 21 is switched to a high speed in Step S16, similarly to Step S2. Then, the whole process moves to Step S17 where it is determined whether or not the transportation belt 21 is rotating normally. If it is determined that the transportation belt 21 is not operating normally, the same operations as performed in Steps S4 and S5 are performed in Steps S18 and S19. If it is determined that the transportation belt 21 is operating normally, the whole process moves to Step S20 where the head cleaning operation is performed, similarly to Step S7.

Even after the image formation period is completed, the printheads 4 are cleaned preferably by ejecting the toners in a large amount. This is because, even if the image forming apparatus is left unused for a long period of time after the image forming operation, the removal of the toners adhered to the peripheries of the toner passage holes 6 prevents the toners that has denatured with variations in environmental conditions from adhering to the heads.

Then, the whole process advances to Step S21 where the supply of low voltages that have been applied to the rear electrodes 3 in Step S9 is stopped, whereby the electric field between the printheads 4 and the transportation belt 21 is extinguished. Then, in Step S22, the application of the reference voltage to the control electrode 7 of each of the printheads 4 is halted. As a result, the electric field formed between the control electrodes 7 and the toner holding members 2 is extinguished.

Meanwhile, the transportation belt 21 from which the image receiving member 5 was separated is cleaned by the belt cleaning unit 23 and the toner 1 adhered to the surface of the transportation belt 21 is removed from the surface of the belt.

When the surface of the transportation belt 21 opposed to the toner supplying units for different colors passes through at least the cleaning unit 23 in Step S23, the rotation of the belt driving roller 22 is stopped and the rotative driving of the transportation belt 21 is stopped. The driving of the fixing unit is also stopped, whereby the printing operation performed by the image forming apparatus according to EMBODIMENT 2 of the present invention is completed.

The detailed image forming operation and the operation of cleaning the heads between consecutive sheets are performed in the same manner as in EMBODIMENT 1. In the case of sequential printing, the toners are gradually deposited at localized points on the printheads 4. To eliminate the localized deposition of the toners, the head cleaning step is performed preferably between consecutive sheets. In terms of the head cleaning ability, the amounts of the toners ejected in the cleaning step performed between consecutive sheets is preferably equal to those ejected in each of the cleaning steps performed prior to the initiation of the image formation period and after the completion thereof. If the toners are ejected in large amounts, however, the problems of in-apparatus contamination and the clogging of the passage holes 6 by the toners deposited on the belt are aggravated. To prevent the large amounts of ejected toners from adhering to the image forming member 5, a wide space should be provided between consecutive sheets so that the number of sheets printed per unit time is reduced. If the transporting speed of the belt is increased between consecutive sheets, the aforementioned problems can be solved. However, since printing in the different colors is performed simultaneously, the transporting speed of the belt cannot be changed midway. Therefore, the amounts of ejected toners and the transporting speed of the belt are maintained preferably in the head cleaning step performed between consecutive sheets during the image formation period.

Thus, EMBODIMENT 2 performs the steps of cleaning the printheads 4 prior to the initiation of the image formation period and after the completion thereof by ejecting the toners larger in amounts than during the image formation period and increasing the moving speed of the transportation belt 21 in addition to the operations shown in EMBODIMENT 1. This ensures the cleaning of the printheads 4 and prevents the in-apparatus contamination due to the jumped toners and the clogging of the toner passage holes 6 by the toners deposited on the transportation belt 21.

Although EMBODIMENT 2 has performed the ejection of the toners during the cleaning of the printheads 4 after the movement of the transportation belt 21 is initiated, the ejection of the toners is not limited to the period during which the printheads 4 are cleaned.

The cleaning of each of the printheads 4 may also be initiated after the rotation of the toner holding member 2. It is also possible to form an electric field between the control electrode 7 and the toner holding member 2 after the cleaning of the printhead 4.

Although EMBODIMENT 2 has used a dry toner as a developer, other toners including a wet toner having toner particles dispersed in a fluid dispersion and a liquid ink having a pigment or dye dispersed therein may also be used.

Although the present embodiment has applied the reference voltage to the control electrode 7, it is also possible to apply a voltage of the polarity opposite to that of the reference voltage to the toner holding member 2. In this case, a voltage outputted from the voltage source 9 for control electrode is required to have only the positive polarity. This prevents an increase in the size of the voltage source 9 for control electrode and an intricate process of designing an IC or transistor for switching the voltage to the control electrode 7 between the ON/OFF states. If an antistatic electrode is provided on the outermost surface of the printhead 4, the same effects are achievable by applying the reference voltage to the antistatic electrode instead of applying it to the control electrode 7.

Although EMBODIMENT 2 has performed head cleaning between the plurality of image receiving members 5, head cleaning need not be performed between each consecutive two of the image receiving members 5 and may be performed as required. For example, the image forming apparatus may be internally equipped with a counter for counting the number of times that the receiving members 5 pass through the positions opposing the printheads 4 so that head cleaning is performed when the number of times reaches a specified value. Head cleaning may also be performed immediately after a power supply for the apparatus is turned ON or during a stand-by period.

INDUSTRIAL APPLICABILITY

In the image forming method and apparatus according to the present invention which eject the developer on the developer supplying member toward the opposing member through the openings of the printhead, the developer is prevented from being deposited at a localized point on the opposing member so that the developer on the opposing member is kept from contact with the printhead and the clogging of the openings is prevented. This reduces the probability of collision between developers on the opposing member and prevents in-apparatus contamination due to the jumped toner. Accordingly, the present invention is high in industrial applicability in terms of promoting commercialization of the image forming method and apparatus capable of providing a quality image.

What is claimed is:

1. A method for forming an image, the method comprising:

an opposing member moving step of moving an opposing member disposed in opposing relation to a developer supplying member for supplying a developer with a printhead interposed therebetween; and an ejecting step of ejecting the developer from the developer supplying member toward the opposing member through openings of the printhead, the ejecting step being initiated after the opposing member moving step is initiated.

2. The method of claim 1, further comprising:

a detecting step of detecting a moving state of the opposing member, wherein the initiation of the ejecting step is controlled based on a result of the detection obtained in the detecting step.

3. The apparatus of claim 1, wherein a plurality of printheads are arranged in a direction of movement of the opposing member and of impact positions of developers ejected through each of the openings of the printheads and impacted on the opposing member during a cleaning period for each of the printheads, at least one is different from the others.

4. The apparatus of claim 3, wherein the plurality of printheads correspond to the developers in a plurality of colors and of the impact positions of the developers impacted on the opposing member during the cleaning period for each of the printheads, the one of the palest color is positioned closer to an image formation region on the opposing member than the impact positions of the developers in the other colors.

5. The apparatus of claim 4, wherein the impact position of the developer in the palest color is positioned closer to a tip of the image formation region on the opposing member in the direction of movement of the opposing member than the impact positions of the developers in the other colors.

6. An apparatus for forming an image, the apparatus comprising:

a developer supplying member for supplying a developer;

an opposing member disposed in opposing relation to the developer supplying member; and a printhead disposed between the developer supplying member and the opposing member and having openings for allowing a developer on the developer supplying member to pass therethrough toward the opposing member based on an image signal from the outside, the developer on the developer supplying member being ejected through the openings of the printhead to clean the openings after the opposing member initiates movement.

7. The apparatus of claim 6, wherein a moving speed of the opposing member is higher when the openings are cleaned by ejecting the developer on the developer supplying means through the openings of the printhead than when a toner image is formed.

8. The apparatus of any one of claims 6 to 5, wherein an intensity of an electric field between the printhead and the opposing member is lower during the cleaning period than during image formation during which an image is formed by ejecting the developer onto the opposing member.

9. The apparatus of any one of claims 6 to 8, wherein the cleaning of the openings of the printhead is initiated before the developer is supplied from the developer supplying member to a vicinity of each of the openings of the printhead.

10. The apparatus of any one of claims 6 to 8, wherein a group of electrodes are provided around the openings of the printhead and a specified electric field is formed between the group of electrodes and the developer supplying member.

11. A method for forming an image, the method comprising:

an opposing member moving step of moving an opposing member disposed in opposing relation to a developer supplying member for supplying a developer with a printhead interposed therebetween; and a cleaning step of ejecting the developer from the developer supplying member toward the opposing member through openings of the printhead and thereby cleaning the openings of the printhead, the cleaning step being initiated after the opposing member moving step is initiated.

12. The method of claim 11, wherein a moving speed of the opposing member is higher in the cleaning step for the printhead than in an image forming step of forming a toner image.

13. The method of claim 12, wherein the plurality of printheads correspond to the developers in a plurality of colors and of the impact positions of the developers impacted on the opposing member in the cleaning step, the one in the palest color is positioned closer to an image formation region on the opposing member than the impact positions of the developers in the other colors.

14. The method of claim 13, wherein the impact position of the developer in the palest color is positioned closer to a tip of the image formation region in a direction in which the opposing member is moved than the impact positions of the developers in the other colors.

15. The method of claim 11, wherein a plurality of printheads are arranged in a direction of movement of the opposing member and of impact positions of developers ejected through each of the openings of the printheads and impacted on the opposing member in the cleaning step, at least one is different from the others.

16. The method of any one of claims 11 to 14, wherein an intensity of an electric field between the printhead and the opposing member is adjusted to be lower in the cleaning step than in an image forming step of forming an image by ejecting the developer onto the opposing member.

17. The method according to any one of claims 11 to 16, further comprising:

a developer supplying step of supplying the developer from the developer supplying member to a vicinity of each of the openings of the printhead, wherein the cleaning step is initiated prior to the developer supplying step.

18. The method according to any one of claims 11 to 17, further comprising:

an electric field forming step of forming a specified electric field between a group of electrodes around the openings of the printhead and the developer supplying member, wherein the electric field forming step is initiated before the cleaning step is initiated.

19. An apparatus for forming an image, the apparatus comprising:

a developer supplying member for supplying a developer;

an opposing member disposed in opposing relation to the developer supplying member; and a printhead disposed between the developer supplying member and the opposing member and having openings for allowing the developer on the developer supplying member to pass therethrough toward the opposing member based on an image signal from the outside, the opposing member initiates movement before the developer on the developer supplying member is ejected through the openings of the printhead.

20. The apparatus of claim 19, further comprising:

detecting means for detecting the movement of the opposing member; and ejection initiation control means for controlling initiation of the ejection of the developer from the developer supplying means if the movement of the opposing member is detected by the detecting means.

* * * * *